US010052630B2

(12) United States Patent
Inganas et al.

(10) Patent No.: US 10,052,630 B2
(45) Date of Patent: Aug. 21, 2018

(54) PRELOADED MICROFLUIDIC DEVICES

(75) Inventors: Mats Inganas, Uppsala (SE); Susanna Lindman, Uppsala (SE); Helene Derand, Taby (SE)

(73) Assignee: GYROS PATENT AB, Uppsala (SE)

( * ) Notice: Subject to any disclaimer, the term of this patent is extended or adjusted under 35 U.S.C. 154(b) by 1689 days.

(21) Appl. No.: 13/019,451

(22) Filed: Feb. 2, 2011

(65) Prior Publication Data

US 2011/0131830 A1 Jun. 9, 2011

Related U.S. Application Data

(63) Continuation of application No. 10/550,137, filed as application No. PCT/SE2004/000440 on Mar. 23, 2004, now abandoned.

(60) Provisional application No. 60/466,376, filed on Apr. 29, 2003.

(30) Foreign Application Priority Data

Mar. 23, 2003 (SE) ..... 0300823

(51) Int. Cl.
*B01L 3/00* (2006.01)

(52) U.S. Cl.
CPC ..... *B01L 3/50273* (2013.01); *B01L 2200/12* (2013.01); *B01L 2200/16* (2013.01); *B01L 2300/069* (2013.01); *B01L 2300/0636* (2013.01); *B01L 2300/0806* (2013.01); *B01L 2400/0406* (2013.01); *B01L 2400/0409* (2013.01); *B01L 2400/0415* (2013.01); *B01L 2400/0487* (2013.01)

(58) Field of Classification Search
None
See application file for complete search history.

(56) References Cited

U.S. PATENT DOCUMENTS 4,175,073 A 11/1979 Carlsson et al.
4,563,304 A 1/1986 Carlsson et al.
4,737,533 A 4/1988 Charmot et al.
5,354,654 A 10/1994 Ligler et al.
5,488,521 A * 1/1996 Lemke ..... G11B 5/6005 360/97.22
5,691,152 A 11/1997 Burton et al.
(Continued)

FOREIGN PATENT DOCUMENTS

EP 0242275 A1 10/1987
EP 0368624 * 5/1990 ..... G01N 33/543
(Continued)

OTHER PUBLICATIONS

Wiki (wiki polystyrene entry dated Dec. 2016).*
(Continued)

*Primary Examiner* — Melanie Yu Brown
*Assistant Examiner* — Richard Moerschell
(74) *Attorney, Agent, or Firm* — Norton Rose Fulbright US LLP

(57) ABSTRACT

A microfluidic device comprising one, two or more microchannel structures (101*a-h*), each of which comprises a reaction microcavity (104*a-h*) intended for retaining a solid phase material in the form of a wet porous bed. Each of said one, two or more microchannel structures comprises the solid phase material in a dry state together with a bed-preserving agent comprising one or more compounds having bed-preserving activity.

27 Claims, 8 Drawing Sheets

(56) References Cited

U.S. PATENT DOCUMENTS

| | | | | |
|---|---|---|---|---|
| 5,726,026 | A | 3/1998 | Wilding et al. | |
| 5,807,997 | A | 9/1998 | Batista | |
| 5,928,880 | A | 7/1999 | Wilding et al. | |
| 5,998,155 | A | 12/1999 | Burton et al. | |
| 6,322,682 | B1 | 11/2001 | Arvidsson et al. | |
| 6,479,299 | B1 | 11/2002 | Parce et al. | |
| 6,506,609 | B1 | 1/2003 | Wada et al. | |
| 6,632,656 | B1 | 10/2003 | Thomas et al. | |
| 6,653,625 | B2 | 11/2003 | Andersson et al. | |
| 6,717,136 | B2 | 4/2004 | Andersson et al. | |
| 6,776,610 | B2 | 8/2004 | Lovgren et al. | |
| 6,812,456 | B2 | 11/2004 | Andersson et al. | |
| 6,812,457 | B2 | 11/2004 | Andersson et al. | |
| 6,852,851 | B1 | 2/2005 | Tooke et al. | |
| 6,884,395 | B2 | 4/2005 | Tooke et al. | |
| 6,919,058 | B2 | 7/2005 | Andersson et al. | |
| 6,955,738 | B2 | 10/2005 | Derand et al. | |
| 6,967,101 | B1 | 11/2005 | Larsson et al. | |
| 6,985,672 | B2 | 1/2006 | Kylberg et al. | |
| 6,990,290 | B2 | 1/2006 | Kylberg et al. | |
| 2001/0008640 | A1* | 7/2001 | Zasadzinski | A61K 9/1274 424/469 |
| 2002/0125135 | A1 | 9/2002 | Derand et al. | |
| 2003/0029724 | A1 | 2/2003 | Derand et al. | |
| 2003/0053934 | A1* | 3/2003 | Andersson | B01F 5/0646 422/72 |
| 2003/0054563 | A1 | 3/2003 | Ljungstrom et al. | |
| 2003/0124623 | A1 | 7/2003 | Yager et al. | 435/7.5 |
| 2003/0129360 | A1 | 7/2003 | Derand et al. | |
| 2003/0143114 | A1 | 7/2003 | Andersson et al. | |
| 2003/0156763 | A1 | 8/2003 | Soderman | |
| 2003/0173650 | A1 | 9/2003 | Larsson et al. | |
| 2003/0211012 | A1 | 11/2003 | Bergstrom et al. | |
| 2003/0211097 | A1* | 11/2003 | Pastan | A61K 47/48561 424/132.1 |
| 2004/0000523 | A1* | 1/2004 | Rosenberg | B01J 20/3242 210/660 |
| 2004/0045546 | A1* | 3/2004 | Hirsh | A61K 9/0078 128/200.14 |
| 2004/0058408 | A1 | 3/2004 | Thomas et al. | |
| 2004/0096867 | A1 | 5/2004 | Andersson et al. | |
| 2004/0099310 | A1 | 5/2004 | Andersson | |
| 2004/0120856 | A1 | 6/2004 | Andersson et al. | |
| 2004/0189311 | A1 | 9/2004 | Glezer et al. | 324/444 |
| 2004/0202579 | A1 | 10/2004 | Larsson et al. | |
| 2005/0019819 | A1 | 1/2005 | Tooke et al. | |
| 2005/0042770 | A1 | 2/2005 | Derand et al. | |
| 2005/0141344 | A1 | 6/2005 | Ekstrand et al. | |
| 2005/0153431 | A1 | 7/2005 | Andersson et al. | |
| 2005/0153432 | A1 | 7/2005 | Andersson et al. | |
| 2005/0153433 | A1 | 7/2005 | Andersson et al. | |
| 2005/0153434 | A1 | 7/2005 | Andersson et al. | |
| 2005/0179901 | A1 | 8/2005 | Ostlin et al. | |
| 2005/0186685 | A1 | 8/2005 | Kange et al. | |
| 2005/0202471 | A1 | 9/2005 | Tooke et al. | |
| 2005/0214442 | A1 | 9/2005 | Larsson et al. | |
| 2005/0277195 | A1 | 12/2005 | Holmquist et al. | |
| 2005/0279925 | A1 | 12/2005 | Andersson et al. | |
| 2006/0148065 | A1 | 7/2006 | Inganas | 435/287.2 |

FOREIGN PATENT DOCUMENTS

| | | | | |
|---|---|---|---|---|
| EP | 0368624 | A2 | 5/1990 | |
| EP | 03686240 | * | 5/1990 | G01N 33/543 |
| JP | 63-010668 | A | 12/1988 | |
| JP | 2-173568 | A | 7/1990 | |
| JP | 9-508532 | T | 9/1997 | |
| JP | 2001-526778 | T | 12/2001 | |
| WO | 9522057 | A1 | 8/1995 | |
| WO | WO-98/07019 | | 2/1998 | |
| WO | 9843739 | A2 | 10/1998 | |
| WO | WO-98/53311 | | 11/1998 | |
| WO | WO-99/58245 | | 11/1999 | |
| WO | WO-00/25921 | | 5/2000 | |
| WO | WO-00/40750 | | 7/2000 | |
| WO | WO-00/62042 | | 10/2000 | |
| WO | WO-00/69560 | | 11/2000 | |
| WO | WO-00/78455 | | 12/2000 | |
| WO | WO-00/79285 | | 12/2000 | |
| WO | WO-01/02737 | | 1/2001 | |
| WO | WO-01/30500 | | 5/2001 | |
| WO | WO-01/87486 | | 11/2001 | |
| WO | WO 01/87487 | | 11/2001 | |
| WO | WO-02/75312 | | 9/2002 | |
| WO | WO-2002/075212 | A1 | 9/2002 | |
| WO | WO-04/83108 | | 9/2004 | |
| WO | WO-04/83109 | | 9/2004 | |
| WO | WO-04/103890 | | 12/2004 | |

OTHER PUBLICATIONS

International Preliminary Report on Patentability for PCT/SE2004/000440 filed Mar. 23, 2004.

International Search Report for PCT/SE2004/000440 filed Mar. 23, 2004.

Arakawa et al., "Factors affecting short-term and long-term stabilities of proteins," *Adv. Drug Deliv. Rev.*, 46(1-3): 307-26, 2001.

* cited by examiner

PRELOADED MICROFLUIDIC DEVICES

CROSS-REFERENCE TO RELATED APPLICATIONS

This application is a continuation application from National Phase Application 10/550,137, filed Sep. 21, 2005, filed from International Application No. PCT/SE2004/000440 filed Mar. 23, 2004 which claims priority to U.S. Provisional Application No. 60/466,376 filed Apr. 29, 2003 and Swedish Application No. 0300823-2 filed Mar. 23, 2003.

TECHNICAL FIELD

The invention relates to a microfluidic device for performing experiments which each comprises interaction between a solid phase material (=support material) and a solute (S or S') that is present in a liquid. The solid phase material is present in the device as porous beds during the experiments. The device permits that one or more experiments can be carried out in parallel within the device.

Parallelity means that at least the interaction between the solute and the solid phase material is carried out in parallel for two or more experiments. The reagents/reactants used may be different.

The term "solute" comprises true solutes, microorganisms including viruses, suspended cells, suspended cell parts and various other reactants that are in dissolved or colloidal form and sufficiently small to be transported by liquid flow through the porous bed that is referred to herein.

The term "microfluidic device" means that the device comprises one or more microchannel structures in which liquid flow is used for transporting various kinds of reactants, analytes, products, samples, buffers and/or the like. The terms "micro" in "microchannel structure" contemplates that there are one or more cavities and/or conduits that have a cross-sectional dimension that is $\leq 10^3$ μm, preferably $\leq 5\times10^2$ μm, such as $\leq 10^2$ μm. The device is capable of processing liquid aliquots in the nanolitre (nl) range (which includes the picolitre (pl) range). The nl-range has an upper end of 5,000 nl but relates in most cases to volumes ≤1,000 nl, such as ≤500 nl or ≤100 nl.

The interaction between the solute and the porous bed contemplates e.g. a) separation of the solute from the liquid, i.e. the solute is retained on the solid phase material with the consequence that the porous bed plus the solute can be separated from the liquid, b) interaction as part of a catalytic reaction, e.g. an enzymatic reaction, c) solid phase synthesis, and/or d) solid phase derivatization.

Patent publications (WO and US applications and issued US patents) cited herein are incorporated by reference in their entirety.

BACKGROUND OF THE INVENTION

WO 02075312 (Gyros AB) focuses on affinity assays for the characterization of reaction variables by binding a soluble affinity reactant to a solid phase material that comprises in immobilized form the counterpart to the affinity reactant. The solid phase is represented by the inner wall of the reaction microcavity or by a porous bed placed in the reaction microcavity.

WO 03093802 (Gyros AB) describes performing catalytic assays with one part of the used catalytic system in immobilized form. The assays are illustrated with enzyme systems. The immobilization techniques and solid phase materials are in principle the same as in WO 02075312 (Gyros AB).

U.S. Pat. No. 5,726,026 (Univ. Pennsylvania) and U.S. Pat. No. 5,928,880 (Univ. Pennsylvania) describe in a side sentence a microfluidic device that comprises a detection/reaction zone containing a solid phase material in particle form. Streptavidin is immobilized to the particles. The particles may be dried or lyophilized.

U.S. Pat. No. 6,479,299 (Caliper) discusses predispensation of soluble and insoluble reagents (assay components) during the manufacture of a microfluidic device. Insoluble reagents may be in lyophilized form.

Applicant has marketed a microscale fluidic device (Gyrolab MALDI SP1) containing a plurality of microchannel structures each of which contains a column of a reverse solid phase material (hydrophobic beads) (WO 02075775 (Gyros AB) and WO 02075776 (Gyros AB)). The solid phase material is in a dry state. In order to secure that the beads are retained in the correct location during storage and transport, the packages of the devices have been specifically designed.

WO 00056808 (Gyros AB), WO 01047437 (Gyros AB), WO 01054810 (Gyros AB), WO 02075775 (Gyros AB) and WO 02075776 (Gyros AB) suggest in general terms to deliver microfluidic devices in dry form.

U.S. Pat. No. 5,354,654 (Ligler et al) suggests a kit comprising a solid support with an immobilized ligand-receptor complex that has been lyophilized together with a cryostabilisator. Packing of the support in a macroscale column is suggested.

U.S. Pat. No. 5,998,155 (Squibb) and U.S. Pat. No. 5,691,152 (Squibb) describes compositions having a high biotin-binding activity. The biotin-binding moiety is immobilized to a polymer support. The support may be in beaded form and lyophilized together with (a) a bulking agent protecting the beads from damages during freeze-drying and assisting the reswelling of the beads, (b) a protectant for inhibiting chemical reactions during freeze-drying and storage, (c) buffers etc.

BACKGROUND PROBLEMS

There are a number of technical problems associated with providing the market with microfluidic devices of the type discussed above. We have found that in the case the customer would introduce a hydrophilic porous bed into the device, there will be a high risk for obtaining mal-functioning beds. In total this would lead to increased inter- and intra-device variations in performance of the beds/microchannel structures, decreased sensitivity and reproducibility for assays carried out in the structures, etc.

In the macroworld the general trend has been to provide preloaded columns with solid phase based separation media in bed form in a wet state. Loss of liquid during storage due to evaporation typically is low compared to the total volume. The situation is quite different for microfluidic devices where bed volumes typically are in the nl-range and evaporation easily becomes significant due to wicking. The result is a high risk for quick uncontrolled drying of a bed and an unacceptable risk for the creation of channels, cavities and inclusion of air that will disturb the liquid flow characteristics of the bed. For solid phase material comprising a bioactive reactant the risk for irreproducible and irreversible changes in activity is also apparent. There are difficulties in reconstituting fully or partly dried solid phase material in microfluidic devices to minute well-ordered and homogeneous porous beds/columns having the liquid flow characteristics and binding activity with essentially the same inter-channel and inter-device variation as the wet beds had before drying.

These problems are typically more pronounced for hydrophilic and/or water-swellable solid phase material than for hydrophobic that do not swell in water. See FIGS. 2*a-b* and 3.

Our experience with wet hydrophilic beds implanted the idea that the beds have to be dried under controlled conditions. It still, however, turned out difficult to implement dried solid phase material that could be reconstituted in the desired way to minute porous beds/columns, e.g.

The solid phase material typically carries a reactant that is sensitive to drying, storage and transportation.

The binding of the solute to a porous bed in a microfluidic device may be monitored by spectrometric methods through a detection window associated with the porous bed. The creation of undesired channels, cavities and air inclusions will increase the noise level for detection and thus also reduce sensitivity and reproducibility.

During transportation of microfluidic devices that comprises porous beds, there is a significant risk that solid phase material may escape from the microcavity. The risk for losses of dispensed reagents and analyte by reactions with escaped solid phase material at undefined locations within a microchannel structure is apparent. This kind of problem is most severe if the bed is built up of particles.

BRIEF SUMMARY OF THE INVENTION

The objects are to provide improved microfluidic devices that solve the problems discussed above. The objects thus comprise to provide microfluidic devices comprising solid phase material in a dry state that after storage and transportation of the device can be reconstituted to wet beds with essentially the same performance as wet beds of the same solid phase material not having being transformed to the dry state. If the solid phase material comprises an immobilized reactant, its activity, e.g. binding activity such as capacity to bind the solute, shall be essentially unchanged by transformation to the dry state, storage, transportation and reconstitution. This in particular applies to activity under flow conditions.

The objects include providing methods for manufacturing the devices and use of the devices for separation and/or assay purposes, among others.

BRIEF DESCRIPTION OF THE DRAWINGS

In FIG. 2*a* the particles have been lyophilized. The particles are lumped together and scattered randomly in the reaction microcavity. No packed bed is at hand.

FIG. 4*a* is after lyophilization and storage together with potassium phosphate.

FIG. 5*a* is without drying, FIG. 5*b* is drying at atmospheric pressure (by wicking), FIG. 5*c* is vacuum-drying, and FIG. 5*d* is lyophilization. The myoglobin concentrations for the various graphs are the same as in FIGS. 4*a-b*.

DETAILED DESCRIPTION OF THE INVENTION

The Invention

Figure 1:
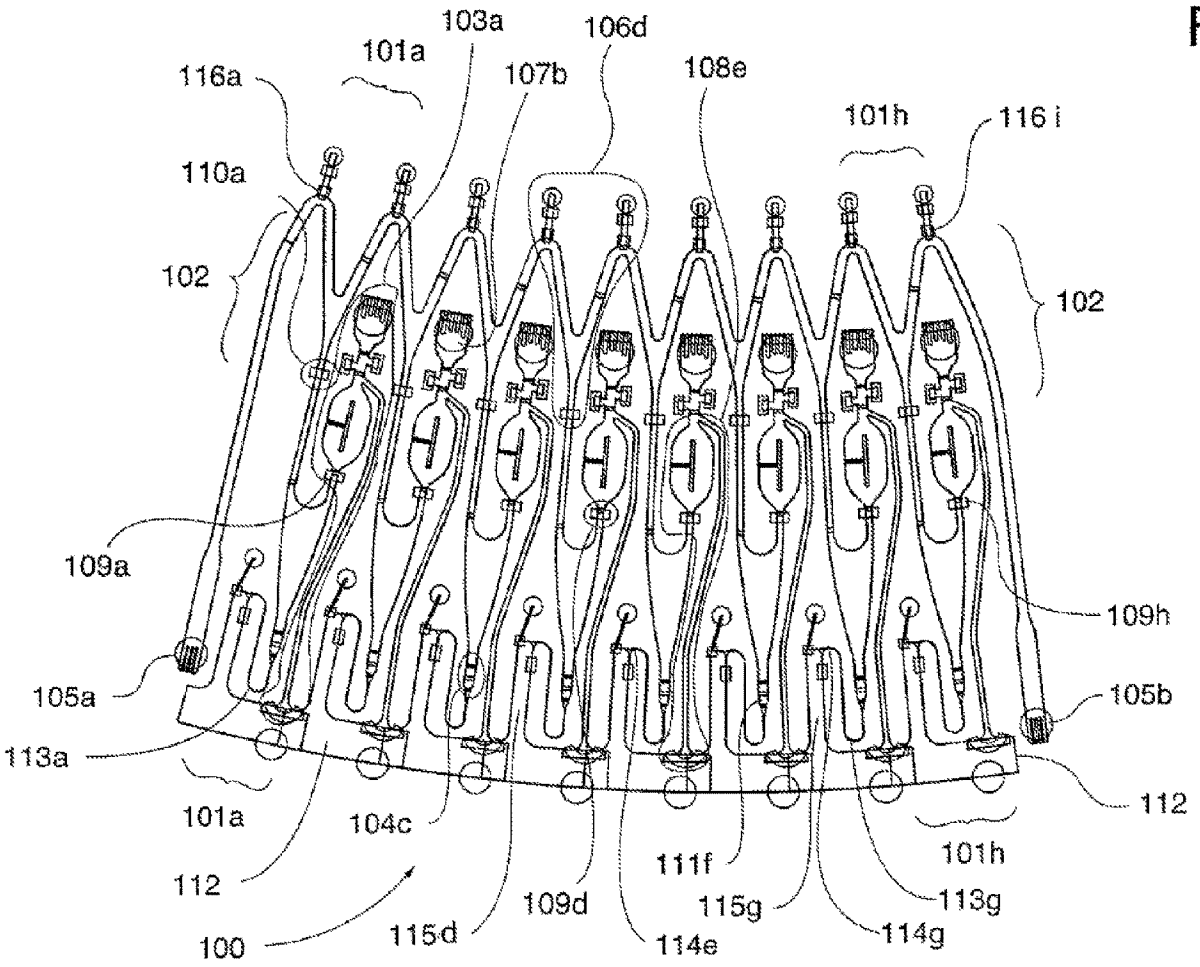
FIG. 1 gives a subgroup (100) of microchannel structures (101*a-h*) of the microfluidic device utilized in the experimental part. For elements 102, 103, 104, 106, 107, 108, 109, 110, 111, 113, 114, 115 and 116, each corresponding element for the successive repeating structures is labeled a, b, c, and so forth as the figure is viewed from left to right.

It has now been discovered that there are certain compounds and/or combinations of compounds that, when intimately mixed with a solid phase material, will reduce adverse effects of predispensing, drying, storage, transportation, reconstitution etc of solid phase materials intended to be used as minute porous beds in microfluidic devices. These negative effects are for example:

a) unacceptable formation of channels, cavities, air inclusions etc and/or,
b) escape of solid phase material from a desired location within a microchannel structure, and/or
c) reduction of the binding activity of an immobilized reactant, e.g. affinity reactant A compound or a combination of compounds that reduces/reduce these adverse effects will henceforth be called "bed-preserving agent" or simply "preserver" since they will assist in restoring a dried solid phase material to an efficient wet porous bed. According to the inventive principle a bed-preserving agent is simply included in the liquid phase of a wet solid phase material before drying/dehydration. Drying can take place inside or outside the microfluidic device. By using the proper inlet arrangements (102, 103*a-h*) such as a distribution manifold (106*a-h*) and or single volume metering units (108*a-h*) described herein, we have found that the accuracy for the formation of reconstituted wet beds of predetermined volume can be further increased. Inter-channel variations due to drying, storage, transportation and/or reconstitution of preloaded solid phase materials can easily be held at a minimum.

It has also been discovered that common flow control as defined in WO 02075312 (Gyros AB) is beneficial for increasing the accuracy when restoring wet porous bed volumes in parallel in reaction microcavities of at least a subset of microchannel structures of a microfluidic device. Centrifugal force, for instance, is useful for improving the yield of efficient porous beds if applied for settling and restoring the beds.

First Aspect: Microfluidic Device

This aspect is a microfluidic device that comprises one, two or more microchannel structures (101), each of which comprises a reaction microcavity (104*a-h*) intended for retaining a solid phase material in the form of a porous bed. The device is characterized in that the reaction microcavity (104*a-h*) in one, two or more of the microchannel structures (101) comprises a hydrophilic solid phase material in a dry state that comprises a compound or a combination of compounds that act as a bed-preserving agent. These compounds thus secure that an acceptable wet porous bed can be restored after a reconstitution liquid has passed the dry state solid phase material. The bed preserving agent(s) is(are) capable of a) stabilizing the solid phase material possibly containing an immobilized reactant (e.g. an affinity reactant) during
   i) transformation of a wet state of the solid phase material to a dry state, and/or
   ii) a subsequent storage and/or transportation, and/or
b) assisting in the reconstitution of the dry state to a wet porous bed.

The term "acceptable wet porous bed" means that the experimental results from the bed can be used, i.e. the bed is functional. The term "unacceptable" means that the experimental results are discarded. The bed-preserving agent thus increases the probability for obtaining acceptable beds. The use of the principles of the invention may thus assist in increasing the yield of functional beds or microchannel structures on a microfluidic device to become ≥70%, such ≥80% or ≥90% or ≥95% or ≥98% of the total number of beds or microchannel structures of a microfluidic device.

By the term "dry state" is meant that the amount of remaining liquid after drying is ≤50%, such as ≤30% or ≤20% or ≤10% of the amount of liquid present in the solid phase material when saturated with the liquid concerned (with no free liquid layer appearing on top of the bed). In many cases this means that the amount of liquid in the solid phase material after drying and/or storage is ≤20% (w/w), such as ≤10% or ≤5%. The liquid referred to is typically water.

Bed-preserving Agents (Additives)

The damages of a porous bed during drying/dehydration and storage typically depend on stresses induced during transformation from a wet state to a dry state in the similar manner as for biologically active material. The choice of bed-preserving agent will depend on the conditions for drying, the solid phase material, kind of immobilized reactant etc. The same compound(s) may act as bed-preserving agent for one solid phase material and/or immobilized reactant but negatively affect other combinations. It will thus be extremely important to test individual preserver candidates [either as single compounds or as combination(s) of compounds] and conditions for the transformation to the dry state and/or the conditions for storage and/or reconstitution before a candidate is used for a particular solid phase material. Testing is typically by trial and error and may include a) physical inspection of the bed to find undesired channels, cavities and air inclusions, and/or b) determination of through flow properties, activity of an immobilized reactant, etc.

Determination of the activity of the immobilized reactant/ligand may include determination of i) the activity profile in the flow direction and/or perpendicular to the flow direction (i.e. the distribution of activity in the bed), ii) the total activity of the bed etc, for instance by testing the bed behavior in a standard type of assay or in an actual future use of the porous bed. If the immobilized reactant is an affinity reactant that is able to capture a solute, the distribution of the solute in the bed after adsorption (capture) may be used to find abnormal local behavior caused by channels, cavities, air inclusions or local inactivation of the reactant, for instance. The total amount of adsorbed solute may give a total view, e.g. a measure of the mean condition of the immobilized reactant after reconstitution. Adsorption in the context of testing is preferably performed under flow conditions, i.e. a liquid containing the solute is allowed to flow through the porous bed. These kinds of testing typically include a comparison with a standard bed and/or standard behavior that may be given by a) tabulated values,
b) preset specifications,
c) the behavior of a bed prepared from non-lyophilized/non-dried solid phase material of the same kind as the lyophilized/dried solid phase material to be tested, etc.

The substeps during which the risk for damages is most significant are primarily the drying step (dehydration step) and the storage as such. In the case freeze-drying is part of the transformation also the freezing step may cause significant damages. For biologically active material, it is well known that particular stabilizators may be required for each substep. Hence, stabilizators have been termed according to kind of substep during which they are active, e.g. cryostabilizators refer to freezing, lyostabilizators to dehydration/drying and long term stabilisators to storage. See for instance Arakawa et al (Advanced Drug Delivery Reviews 46 (2001) 307-326). In the context of the present invention the analogous categorization is used for bed-preserving agents.

Compounds that assist in the reconstitution of the dry solid phase material to the wet porous bed are called bed-reconstitution agents and are also bed-preserving agents.

A bed-preserving agent may be active in relation to at least one up to all of the steps: drying/dehydration, freezing, storage and reconstitution. The efficiency of a particular agent will depend on the conditions for the particular step, solid phase material and/or immobilized reactant to be stabilized.

A bed-preserving agent that is useful in the present invention typically is hydrophilic in the sense that it is water-soluble. Many bed-preserving agents thus exhibit one or more heteroatoms selected from oxygen, nitrogen and sulphur, typically with a ratio between the total number of carbon atoms and the total number of oxygen, nitrogen and sulphur atoms which is ≤6, such as ≤4 or ≤2.

Typical bed-preserving agents may be found in the group consisting of compounds exhibiting a) carbohydrate structure which also includes sugar alcohol structure, b) polyhydroxy structure (i.e. organic polyols which also includes polyhydroxy polymers), c) amino acid structure including peptide structure and imino acid structure, d) inorganic salts, e) organic salts in particular carboxylates, f) amine structure including amino acid structure and ammonium structure, h) etc.

Suitable compounds with carbohydrate structures may be found amongst sucrose, lactose, glucose, trehalose, maltose, isomaltose, cellobiose, inositol, ethylene glycol, glycerol, sorbitol, xylitol, mannitol, polyethylene glycol possibly substituted in one or both of its end, dextran, maltodextrin, monosaccharides, disaccharides, polysaccharides including oligosaccharides etc. Compounds with carbohydrate structures are typically also polyols.

Suitable polyols may be found amongst polyhydroxy polymers, such as polysaccharides, polyvinylalcohol possibly partially substituted on its hydroxy groups for instance with acetate or lower hydroxy alkyl groups ($C_{2-4}$), poly (lower hydroxy alkyl ($C_{2-4}$) acrylate) polymers and corresponding poly methacrylate polymers etc, and monomeric compounds having two or more hydroxy groups. In a typical polyol each hydroxy group is attached directly to an $sp^3$-hybridized carbon.

Suitable polymers are typically found amongst polymers that have a plurality of functional groups comprising a heteroatom selected from oxygen and nitrogen. Relevant functional groups are —$O(CH_2CH_2O)_n$— where n is ≥2 such as ≥5, amido such as —CONH— or —$CONH_2$ (where H may be replaced with a suitable hydrophilic organic group), hydroxy (OH), ester (—COOR, where R is a suitable hydrophilic organic group), etc. Specific examples are polyethylene glycol, dextran and other polysaccharides, polyvinylpyrrolidone, polypeptides, the poly acrylate and methacrylate polymers mentioned above, the polyvinyl alcohols mentioned above etc.

The term "polymer" above also includes copolymer in which the specific polymer structure mentioned is a part Bed-preserving agents that are lyostabilizators are believed to act during the drying/dehydration step by replacing water bound to the solid phase material to be stabilized. These bed-preserving agents thus primarily are found among compounds that may participate in hydrogen bonding/coordination with the solid phase material. With the present knowledge the most typical candidates for lyostabilization are found amongst polyols (including diols, triols etc), e.g. with a polymeric structure and/or carbohydrate structure (oligomeric is included in polymeric). In the case the solid phase material comprises an immobilized reactant, e.g. with peptide structure, it is believed that the most efficient candidates have carbohydrate structure with preference for disaccharides and found amongst sucrose, lactose, glucose, trehalose, maltose, isomaltose, cellobiose etc.

Many times suitable bed-preserving agents, such as lyostabilizators and stabilisators for long term storage are capable of existing in a glassy state in the reaction microcavity possibly in admixture with one or more of the other components that are present in the reaction microcavity.

The bed-preserving agents that are present in the dry state of a solid phase material are typically non-volatile. This does not exclude that volatile cryostabilizators are included during lyophilization.

Protectants (Additives)

The solid phase material that is in a dry state may also contain one or more so-called protectants that inhibit undesired chemical reactions of the solid phase material and/or the immobilized reactant. Suitable protectants are found amongst free radical scavengers, antioxidants, reducing agents etc.

Other Additives

The solid phase material in a dry state may also contain an appropriate buffer, such as a buffer with non-volatile buffering components, e.g. with at least one or two of the buffering components being anionic, such as in phosphate buffers, citrate buffers etc. Also other buffers may be used. The buffering components typically provide an elevated buffer capacity within an appropriate pH interval of the range of pH 1-13 with preference for the range 3-11. For lyophilized solid phase materials, phosphate buffers, in particular with potassium as counter-ion, are preferred.

Other additives such as one or more antimicrobial agents may also be included, e.g. a bacteriostat, a bacteriocid, a virucid etc.

A possible bulking agent may also be included as an additive. The bulking agent may have bed-preserving effects on the solid phase material as discussed above for bed preserving agents in general.

Microcavity adherence agents (a kind of bed-preserving agents) cause the solid phase material to be retained in a reaction microcavity and therefore assist in restoring a dry state solid phase material to a wet porous bed. This kind of agents acts by causing particles to adhere to each other and/or to the inner walls of a reaction microcavity. Microcavity adherence agents may be found amongst the bed-preserving candidates discussed above, for instance amongst those that exhibit carbohydrate and/or polymeric structure.

The various additives (bed preserving agents, buffer substances, protectants, bulking agents etc) are typically present in the solid phase material that is in the dry state in an amount in the interval of 0.0001-25%, such as ≥0.001% or ≥0.01% or ≥0.1% and/or ≤10% or ≤1%. These intervals apply to each individual additive as well as to the total amount of additive with the proviso that the total amount should not exceed the upper limit of an interval. The determination of optimal ranges of efficient amounts and sufficient bed-preserving effects of individual bed-preserving agents needs experimental testing as discussed above. The %-figures refer to the weight of the additive(s) relative to the total weight of solid phase material in the dry state.

Additives (stabilisators, buffer substances, protectants, antimicrobials and/or bulking agents) are typically soluble in aqueous media so that they easily can be removed from the reconstituted porous bed, for instance by transporting liquid through the reconstituted wet bed (washing).

Reaction Microcavity (104*a-h*) and the Solid Phase Material.

The reaction microcavity (104*a-h*) is defined as the part of a microchannel structure (101*a-h*) in which the solid phase is present. This means that for solid phases in the form of porous beds, the bed volume and the reaction microcavity (104*a-h*) will coincide and have the same volume. If the solid phase is the inner wall of a microconduit, the reaction microcavity (104*a-h*) is defined as the volume between the most upstream and the most downstream end of the solid phase.

The reaction microcavity (104*a-h*) is typically a straight or bent microconduit that may or may not be continuously widening and/or narrowing. On the same device all reaction microcavities typically have essentially the same shape and/or size. In a microfluidic device that comprises reaction microcavities according to the invention that differ in shape and/or size, the reaction microcavities/microchannel structures (104*a-h*/101*a-h*) may be divided into groups where each group contains reaction microcavities that are not present in any of the other groups. Each group may be placed in a subarea of the device that is separate from the subareas of other groups.

The reaction microcavity (104*a-h*) has at least one cross-sectional dimension that is ≤1,000 μm, such as ≤500 μm or ≤200 μm (depth and/or width). The smallest cross-sectional dimension is typically ≥5 μm such as ≥25 μm or ≥50 μm. The total volume of the reaction microcavity is typically in the nl-range, such as ≤5,000 nl, such as 1,000 nl or ≤500 nl ≤100 nl or ≤50 nl or ≤25 nl.

The porous bed is a) a population of porous or non-porous particles, or b) a porous monolith.

A monolithic bed may be in the form of a porous membrane or a porous plug.

The term "porous particles" have the same meaning as in WO 02075312 (Gyros AB).

Suitable particles are spherical or spheroidal (beaded) or non-spherical. Suitable mean diameters for particles used as solid phases are typically found in the interval of 1-100 μm with preference for mean diameters that are ≥5 μm, such as ≥10 μm or ≥15 μm and/or ≤50 μm. Also smaller particles can be used, for instance with mean diameters down to 0.1 μm. The design of outlet end (111*a-h*) of the reaction microcavity (104*a-h*) and the particles should match each other so that the particles can be retained in the reaction microcavity (104*a-h*). Certain kinds of particles, in particular particles of colloidal dimension, may agglomerate. In these cases the size of the agglomerate should be in the intervals given even if the agglomerating particles as such are smaller. See for instance WO 02075312 (Gyros AB). Diameters refer to the "hydrodynamic" diameters.

Particles to be used may be monodisperse (monosized) or polydisperse (polysized) in the same meaning as in WO 02075312 (Gyros AB).

The solid phase material may or may not be transparent.

The base material of a solid phase may be made of inorganic and/or organic material. Typical inorganic materials comprise glass and typical organic materials comprise organic polymers. Polymeric materials comprise inorganic polymers, such as glass and silicone rubber, and organic polymers that may be of synthetic or biological origin (biopolymers). The term biopolymer includes semi-synthetic polymers in which there is a polymer backbone derived from a native biopolymer. Typical synthetic organic polymers are cross-linked and are often obtained by the polymerization of monomers comprising polymerizable carbon-carbon double bonds. Examples of suitable monomers are hydroxy alkyl acrylates and corresponding methacrylates, acryl amides and methacrylamides, vinyl and styryl ethers, alkene substituted polyhydroxy polymers, styrene, etc. Typical biopolymers may or may not be cross-linked. In most cases they exhibit a carbohydrate structure, e.g. agarose, dextran, starch etc.

The term "hydrophilic" in the context of a porous bed contemplates a sufficient wettability of the surfaces of the pores for water to be spread by capillarity all throughout the bed when in contact with excess water (absorption). The expression also means that the inner surfaces of the bed that is in contact with water during the absorption shall expose a plurality of polar functional groups which each has a heteroatom selected amongst oxygen and nitrogen, for instance. Appropriate functional groups can be selected amongst hydroxy groups, ethylene oxide groups (—X—$[CH_2CH_2O—]_n$ where n is an integer >1 and X is nitrogen or oxygen), amino groups, amide groups, ester groups, carboxy groups, sulphone groups etc, with preference for those groups that are essentially uncharged independent of pH, for instance within the interval of 2-12. For solid phase materials in particle form this means that at least the outer surfaces of the particles have to exhibit polar functional groups. The hydrophilic functional groups may be present on or be a part of so called extender arms (tentacles).

If the base material of a solid phase material is hydrophobic or not sufficiently hydrophilic, e.g. is based on a styrene (co)polymer, the surfaces that are to be in contact with an aqueous liquid may be hydrophilized. Typical protocols comprise coating with a compound or mixture of compounds exhibiting polar functional groups of the same type as discussed above, treatment by an oxygen plasma etc.

The solid phase material in a dry state may be swellable when contacted with the reconstitution liquid. Swellable materials are likely to be more prone to give problems related to (a) shrinkage/swelling, and inhomogeneous packing and/or through flow after reconstitution, and/or (b) escape of dry particles during storage and transportation. The term "swellable" in this context means an increase in volume of the material (particles as such or a monolith) can be detected when the material in the dry state (as defined above) is contacted with the reconstitution liquid (that may be aqueous such as water). The increase in volume may for instance be ≥10 or ≥75% of the volume of the material in a dry state. Solid phase materials that are not swellable according to this definition are considered non-swellable.

The solid phase material may be rigid or elastic.

The solid phase material may or may not contain an immobilized reactant that is capable of participating in an organic, an inorganic, a biochemical reaction etc with a solute. Depending on the circumstances and the kind of reactant and solute, the interaction between the immobilized reactant and the solute may be part of a separation process, a catalytic reaction, a solid phase synthesis, a solid phase derivatization etc.

The immobilized reactant will now be illustrated with an affinity reactant that is an affinity counterpart ($AC_S$) to a solute (S) and capable of forming an affinity complex ($AC_S$-S) with the solute. Affinity bonds typically are based on: (a) electrostatic interactions, (b) hydrophobic interactions, (c) electron-donor acceptor interactions, and/or (d) bioaffinity binding.

Bioaffinity binding typically is complex and comprises a combination of interactions, such as (a)-(c) above.

An immobilized affinity counterpart ($AC_S$) may thus:

(a) be electrically charged or chargeable, i.e. contains positively charged nitrogen (e.g. primary, secondary, tertiary or quaternary ammonium groups, and amidinium groups) and/or negatively charged groups (e.g. carboxylate groups, phosphate groups, phosphonate groups, sulphate groups and sulphonate groups); and/or (b) comprise one or more hydrocarbyl groups and other hydrophobic groups; and/or (c) comprise one or more heteroatoms (O,S,N), possibly linked to hydrogen and/or sp-, $sp^2$ - and/or $sp^3$-hybridized carbon, and/or (d) comprise a combination of features (a)-(c).

A bioaffinity reactant/ligand is a member of a bioaffinity pair. Typical bioaffinity pairs are a) antigen/hapten and an antibody, b) complementary nucleic acids, c) immunoglobulin-binding protein and immunoglobulin (for instance IgG or an Fc-part thereof and protein A or G), d) lectin and the corresponding carbohydrate, e) biotin and (strept)avidin, e) members of an enzymatic system (enzyme-substrate, enzyme-cofactor, enzyme-inhibitor etc), f) an IMAC group and an amino acid sequence containing histidyl and/or cysteinyl and/or phosphorylated residues (i.e. an IMAC motif), etc. Antibody includes antigen binding fragments and mimetics of antibodies. The term "bioaffinity pair" includes also affinity pairs in which one or both of the members are synthetic, for instance mimicking one or both of the members of a native bioaffinity pair. The term IMAC stands for an immobilized metal chelate.

The term "affinity reactant" also includes a reactant that is capable of reversible covalent binding, for instance by disulfide formation. This kind of reactants typically exhibits a HS— or a —S—$SO_n$— group (n=0, 1 or 2, free valences bind to carbon). See U.S. Pat. No. 5,887,997 (Batista), U.S. Pat. No. 4,175,073 (Axén et al), and U.S. Pat. No. 4,563,304 (Axén et al).

The immobilized reactant/ligand (affinity reactant) may also be a catalytic system or a member of a catalytic system, such as a catalyst, a cocatalyst, a cofactor, a substrate or cosubstrate, an inhibitor, a promotor etc. For enzymatic systems the corresponding members are enzyme, cocatalyst, cofactor, coenzyme, substrate, cosubstrate etc. The term "catalytic system" also includes linked catalytic systems, for instance a series of systems in which the product of the first system is the substrate of the second catalytic system etc and whole biological cells or a part of such cells.

The immobilized affinity reactant ($AC_S$) should be selected to have the appropriate selectivity and specificity for interacting with the solute of interest to the solid phase material in relation to an intended application. General methods and criteria for the proper selection of affinity reactants and reaction conditions are well known in the field.

The affinity constant ($K_{S\text{-}AC}$=[S][$AC_S$]/[S-$AC_S$]) for the formation of the complex comprising the immobilized affinity reactant ($AC_S$) and the solute (S) is an important criterion for optimizing an application and varies depending on application. For affinity assays the affinity constant is typically $\leq 10^{-8}$ mole/l or $\leq 10^{-9}$ mole/l. This kind of assays typically includes that the solute is reacted with immobilized $AC_S$ under flow conditions and related to the amount of an analyte in an animal or biological sample (animal or biological sample include samples from mammals, such as human and other animal patients, and from experimental animals). This does not exclude that affinity counterparts having weaker affinities may be used for this kind of samples, other samples and affinity assays, and other applications. Thus depending on application the affinity constant may be relatively large, such as up to $10^{-3}$ mole/l or up to $10^{-4}$ mole/l or up to $10^{-5}$ or up to $10^{-7}$ mole/l , or relatively low, such as less than $10^{-8}$ mole/or less than $10^{-11}$ mole/l.

The techniques for immobilization of a reactant/ligand may be selected amongst techniques that are commonly known in the field. The linkage to the solid phase material may thus be via covalent bonds, affinity bonds (for instance biospecific affinity bonds), physical adsorption etc.

Immobilization via affinity bonds may utilize an immobilizing affinity pair in which one of the members (immobilized ligand or L) is firmly attached to the solid phase material, for instance covalently. The other member (immobilizing binder, B) of the pair is used as a conjugate (immobilizing conjugate) comprising binder B and the affinity counterpart $AC_S$ to the solute S. Examples of immobilizing affinity pairs are a) streptavidin/avidin/neutravidin and a biotinylated reactant (or vice versa), b) antibody and a haptenylated reactant (or vice versa), c) an IMAC group and an amino acid sequence containing histidyl and/or cysteinyl and/or phosphorylated residues (i.e. an IMAC motif) linked to or being a part of a reactant, etc.

The term "conjugate" primarily refers to covalent conjugates, such as chemical conjugates and recombinantly produced conjugates (where both the moieties have peptide structure). The term also includes so-called native conjugates, i.e. affinity reactants exhibiting two binding sites that are spaced apart from each other, with affinity directed towards two different molecular entities, for instance a native antibody that comprises species and class-specific determinants on one side (=one part) of the molecule and antigen/hapten-binding sites on another side (=one part).

It is believed that it is advantageous that the immobilized ligand L has two or more binding sites for the immobilizing binder B, and/or the immobilizing binder B has one, two or more binding sites for the ligand L (or vice versa).

Preferred immobilizing affinity pairs (L and B) typically have affinity constants ($K_{L\text{-}B}$=[L][B]/[L-B]) that are at most equal to or ≤10 times or $10^2$ times or $\leq 10^3$ times larger than the corresponding affinity constant for streptavidin and biotin. This typically will mean affinity constants that roughly are $\leq 10^{-13}$ mole/l, $\leq 10^{-12}$ mole/l, $\leq 10^{-11}$ mole/l and $\leq 10^{-10}$ mole/l, respectively. The preference is to select L and B amongst biotin-binding compounds and streptavidin-binding compounds, respectively, or vice versa.

The affinity constants discussed above refer to values obtained by a biosensor (surface plasmon resonance) from Biacore (Uppsala, Sweden), i.e. with the affinity reactant ($AC_S$ and L) immobilized to a dextran-coated gold surface.

At least one of the members of an affinity pair, in particular a bioaffinity pair, to be used in the present invention typically exhibits a structure selected amongst: a) amino acid structure including peptide structure such as poly and oligopeptide structure, b) carbohydrate structure, c) nucleotide structure including nucleic acid structure, d) lipid structure such as steroid structure, triglyceride structure etc. The term affinity pair in this context refers to the immobilizing affinity pair (L and B), the immobilized affinity reactant and the solute ($AC_S$ and S) and other affinity pairs that may be used.

The solid phase material that is in a dry state may alternatively be in activated form. In other words ready for direct covalent immobilization by reaction with a functional group of a desired reactant. The functional group that can be used on the desired reactant is typically selected amongst electrophilic and nucleophilic groups and depends on whether or not the activated group is nucleophilic or electrophilic, respectively. Examples of functional groups that may be used are amino groups and other groups comprising substituted or unsubstituted —$NH_2$, carboxy groups (—COOH—$COO^-$), hydroxy groups, thiol groups, keto groups etc.

Other Features of the Microfluidic Device

A microchannel structure (101*a-h*) of a microfluidic device comprises functional parts that permit the full protocol of an experiment to be performed within the structure. A microchannel structure (101*a-h*) of the microfluidic device thus may comprise one, two, three or more functional parts selected among: a) inlet arrangement (102,103*a-h*) comprising for instance an inlet port/inlet opening (105*a-b*, 107*a-h*), possibly together with a volume-metering unit (106*a-h*,108*a-h*), b) microconduits for liquid transport, c) reaction microcavity (104*a-h*); d) mixing microcavity/unit; e) unit for separating particulate matters from liquids (may be present in the inlet arrangement), f) unit for separating dissolved or suspended components in the sample from each other, for instance by capillary electrophoresis, chromatography and the like; g) detection microcavity; h) waste conduit/microcavity (112,115*a-h*); i) valve (109*a-h*,110*a-h*); j) vent (116*a-i*) to ambient atmosphere; etc. A functional part may have more than one functionality, e.g. reaction microcavity (104*a-h*) and a detection microcavity may coincide. Various kinds of functional units in microfluidic devices have been described by Gyros AB/Amersham Pharmacia Biotech AB: WO 99055827, WO 99058245, WO 02074438, WO 02075312, WO 03018198 (US 20030044322), WO 03034598, SE 03026507 (SE 04000717, U.S. Ser. No. 60/508,508), SE 03015393 (U.S. Ser. No. 60/472,924) and by Tecan/Gamera Biosciences: WO 01087487, WO 01087486, WO 00079285, WO 00078455, WO 00069560, WO 98007019, WO 98053311.

In advantageous forms a reaction microcavity (104*a-h*) intended for a hydrophilic porous bed is connected to one or more inlet arrangements (upstream direction) (102,103*a-h*), each of which comprises an inlet port (105*a-b*,107*a-h*) and at least one volume-metering unit (106*a-h*,108*a-h*). In one advantageous variant, there is one separate inlet arrangement (103*a-h*) per microchannel structure (101*a-h*) and reaction microcavity (104*a-h*) intended to contain the solid phase material. In another advantageous variant, the inlet arrangement (102) is common to all or a subset (100) of microchannel structures (101*a-h*) and reaction microcavities (104*a-h*) intended to contain the solid phase material and comprises a common inlet port (105*a-b*) and a distribution manifold with one volume-metering unit (106*a-h*) for each microchannel structure/reaction microcavity (101*a-h*/104*a-h*) of the subset (100). In both variants, each of the volume-metering units (106*a-h*,108*a-h*) in turn is communicating with downstream parts of its microchannel structure (101*a-h*), e.g. the reaction microcavity (104*a-h*). Microchannel structures linked together by a common inlet arrangement (102) and/or common distribution manifold define a group or subset (100) of microchannel structures. Each volume-metering unit (106*a-h*,108*a-h*) typically has a valve (109*a-h*,110*a-h*) at its outlet end. This valve is typically passive, for instance utilizing a change in chemical surface characteristics at the outlet end, such as a boundary between a hydrophilic and hydrophobic surface (hydrophobic surface break) (WO 99058245 (Amersham Pharmacia Biotech AB)) and/or in geometric/physical surface characteristics (WO 98007019 (Gamera)).

Typical inlet arrangements with inlet ports, volume-metering units, distribution manifolds, valves etc have been presented in WO 02074438 (Gyros AB), WO 02075312 (Gyros AB), WO 02075775 (Gyros AB) and WO 02075776 (Gyros AB).

The microfluidic device may also comprise other common microchannels/micro conduits connecting different microchannel structures. Common channels including their various parts such as inlet ports, outlet ports, vents, etc., are considered part of each of the microchannel structures they are communicating with.

Common microchannels make it possible to construe microfluidic devices in which the microchannel structures form networks. See for instance U.S. Pat. No. 6,479,299 (Caliper).

Each microchannel structure has at least one inlet opening (105*a-b*,107*a-h*) for liquids and at least one outlet opening for excess of air (vents) (116*a-i*) and possibly also for liquids (circles in the waste channel (112)).

The microfluidic device may also comprise microchannel structures that have no reaction microcavity for retaining a solid phase material according to the invention.

The microfludic device contains a plurality of microchannel structures/device intended to contain the solid phase according to the invention. Plurality in this context means two, three or more microchannel structures and typically is ≥10, e.g. ≥25 or ≥90 or ≥180 or ≥270 or ≥360. As discussed above the microcannel structures of a device may be divided in groups or subsets (100), each of which may for instance be defined by the size and/or shape of the reaction microcavity, by a common microchannel (102,112), such as a common inlet arrangement (102) with manifold, common waste channel (112) etc. The number of microchannel structures in a group or subset is typically in the interval 1-99%, such as 5-50% or 5-25% or 10-50%, of the total number of microchannel structures of the device. This typically means that each group typically comprises from 3-15 or 3-25 or 3-50 microchannel structures. Each group may be located to a particular area of the device.

Different principles may be utilized for transporting the liquid within the microfluidic device/microchannel structures between two or more of the functional parts described above. Inertia force may be used, for instance by spinning the disc as discussed in the subsequent paragraph. Other useful forces are capillary forces, electrokinetic forces, non-electrokinetic forces such as capillary forces, hydrostatic pressure etc.

The microfluidic device typically is in the form of a disc. The preferred formats have an axis of symmetry ($C_n$ that is perpendicular to or coincides with the disc plane, where n is an integer ≥2, 3, 4 or 5, preferably ∞ ($C_\infty$). In other words the disc may be rectangular, such as square-shaped and other polygonal forms but is preferably circular. Once the proper disc format has been selected centrifugal force may be used for driving liquid flow. Spinning the device around a spin axis that typically is perpendicular or parallel to the disc plane may create the necessary centrifugal force. In the most obvious variants at the priority date, the spin axis coincides with the above-mentioned axis of symmetry.

For preferred centrifugal-based variants, each microchannel structure comprises one upstream section that is at a shorter radial distance than a downstream section (from the spin axis). The reaction microcavity intended for the porous bed is typically at a radial position intermediary to the two sections.

If centrifugal force is used for the formation and/or reconstitution of a particle bed and/or for driving liquid flow through the bed, the reaction microcavity is typically oriented with the flow direction radially outwards from the spin axis.

The preferred devices are typically disc-shaped with sizes and/or forms similar to the conventional CD-format, e.g. sizes that are in the interval from 10% up to 300% of a circular disc with the conventional CD-radii (12 cm). The upper and/or lower sides of the disc may or may not be planar.

Microchannels/microcavities of a microfluidic devices may be manufactured from an essentially planar substrate surface that exhibits the channels/cavities in uncovered form that in a subsequent step are covered by another essentially planar substrate (lid). See WO 91016966 (Pharmacia Biotech AB) and WO 01054810 (Gyros AB). Both substrates are preferably fabricated from plastic material, e.g. plastic polymeric material.

The fouling activity and hydrophilicity of inner surfaces should be balanced in relation to the application. See for instance WO 0147637 (Gyros AB).

The terms "wettable" (hydrophilic) and "non-wettable" (hydrophobic) contemplate that a surface has a water contact angle ≤90° or ≥90°, respectively. In order to facilitate efficient transport of a liquid between different functional parts, inner surfaces of the individual parts should primarily be wettable, preferably with a contact angle ≤60° such as ≤50° or ≤40° or ≤30° or ≤20°. These wettability values apply for at least one, two, three or four of the inner walls of a microconduit. In case one or more of the inner walls have a higher water contact angle this can be compensated for by a lower water contact angle for the inner wall(s). The wettability, in particular in inlet arrangements should be adapted such that an aqueous liquid will be able to fill up an intended microcavity by capillarity (self suction) once the liquid has started to enter the cavity. A hydrophilic inner surface in a microchannel structure may comprise one or more local hydrophobic surface breaks in a hydrophilic inner wall, for instance for introducing a passive valve, an anti-wicking means, a vent solely function as a vent to ambient atmosphere etc (rectangles in FIG. 1). See for instance WO 99058245 (Gyros AB) and WO 02074438 (Gyros AB).

Contact angles refer to values at the temperature of use, typically +25° C., are static and can be measured by the method illustrated in WO 00056808 (Gyros AB) and WO 01047637 (Gyros AB).

Second Aspect: Method for the Transformation of a Plurality of Wet Porous Beds to a Dry/Dehydrated State that Possibly is Reconstituted to a Plurality of Wet Porous Beds.

This aspect is a method as defined in the heading of this section. The method is characterized in comprising the steps of:

i) providing a microfluidic device comprising a plurality of microchannel structures (101*a-h*) each of which comprises a reaction microcavity (104*a-h*) containing a hydrophilic porous bed saturated with a liquid containing a bed-preserving agent, ii) transforming the bed in each reaction microcavity (104*a-h*) to a solid phase material that is in a dry and/or dehydrated state while being retained in the reaction microcavity, iii) possibly reconstituting in each reaction microcavity (104*a-h*) the solid phase material obtained in step ii) to the wet porous beds.

This aspect also concerns a method for reducing the inter-channel variation in a microfluidic device with respect to performance of reconstituted porous beds.

The solid phase material may or may not exhibit a reactant that can interact with a solute in a subsequently introduced liquid aliquot. Various characteristics are discussed below and elsewhere in this specification.

Step (iii) is preferably carried out under flow conditions, for instance with residence time and flow rates through the bed as discussed for the third aspect of the invention.

Porous particle beds can be created by flowing a dispersion of particles through all or one or more subsets (100) of the reaction microcavities (104*a-h*) of the microfluidic device. The particles will then settle and form a porous bed at the outlet end (111*a-h*) of each microcavity (104*a-h*). Bed formation may be facilitated by the use of gravity and/or the use of centrifugal force, the latter preferably acting along the flow direction of each reaction microcavity (104*a-h*). The desired additives as discussed above are present in the liquid dispersion and/or introduced by passing a liquid containing the additives through the bed after it has been formed. The microfluidic device together with the beds saturated with a liquid containing the additives is saved until transformation to the dry state.

A porous monolithic bed is typically introduced during the manufacture of the device, for instance a) by polymerization, or b) by placing ready-made porous monoliths in each of at least one subset (100) of the reaction microcavities (104*a-h*) of the microfluidic device.

In alternative a) the preferred variant is to carry out the polymerization with the reaction microcavity (104*a-h*) and the corresponding microchannel structure (101*a-h*) in an enclosed form. In alternative b) the preferred variant is to insert the monolith while at least the reaction microcavity (104*a-h*) is uncovered (and remaining part of the microchannel structure (101*a-h*) is covered). After introduction of the porous bed and if needed enclosing the microcavity, the beds are saturated with a solution comprising the additives discussed above and saved until transformation to the dry state.

Transformation of the beds to the dry state may be accomplished by removing the liquid under subatmospheric pressure, for instance below and/or above the freezing point of the liquid they are saturated with. Removal under subatmospheric pressure and below the freezing point typically means lyophlization. Alternatively liquid is removed from the settled dispersion under the pressure of ambient atmosphere with or without warming.

In the case the device is designed for driving liquid transport by centrifugal force so called spin-drying may be employed. See description of FIG. 1 in the experimental part.

Due to the small dimensions and inner edges between the walls around the reaction microcavity wicking will be an important factor in drying/dehydration/evaporation, in particular at atmospheric pressure.

The reconstitution of the wet porous beds means that a reconstitution liquid is allowed to flow through each of the reaction microcavities containing solid phase material in a dry state. See the experimental part.

An important tool for treating the solid phase material equally and/or in parallel in several structures is to provide each microchannel structure (101*a-h*) with an inlet arrangement (102,103*a-h*) that in preferred variants is common (102) to a group/subset (100) of microchannel structures/reaction microcavities (101*a-h*/104*a-h*) as discussed for the first aspect. Thus this kind of design will facilitate parallel dispensation of solid phase material as well as parallel reconstitution and conditioning of porous beds. In order to accomplish the best benefits of the invention it is thereby important to provide inner surfaces of at least the inlet arrangements (102,103*a-h*), distribution manifold, and/or individual volume-metering units (106*a-h*/108*a-h*) with hydrophilic surface characteristics within the limits discussed elsewhere in this specification and the outlet of each volume-metering unit (106*a-h*,108*a-h*) with a valve function (109*a-h*,110*a-h*) that preferably is passive in the sense that it is without movable parts, for instance in the form of a local hydrophobic surface break.

Third Aspect of the Invention. The Use of the Device.

The use of the innovative microfluidic devices comprises in general terms the steps of:

(i) providing a microfluidic device according to the first aspect of the invention;

(ii) reconstituting the solid phase material that is in the dry state to a wet porous bed in a predetermined number of the microchannel structures/reaction microcavities (101*a-h*/104*a-h*), preferably under flow conditions, (iii) providing a liquid containing a solute (S') in a position that is upstream to said wet porous bed in one or more of the microchannel structures (101*a-h*) containing the wet porous bed, (iv) transporting the liquid through said wet bed in at least one of said one or more microchannel structures (101*a-h*).

Steps (i) and (ii)

These steps are according to the first and second aspects of the invention.

Steps (iii) and (iv)

The solute (S') is typically capable of interacting with the wet porous bed.

Step (iii) comprises that the solute (S') is formed within the device/microchannel structure or is dispensed to the microchannnel structure. If applicable, formation is typically in a position upstream or within the wet porous bed/reaction microcavity (104*a-h*). Dispensing is typically to an inlet port (105*a-b*,107*a-h*) at a position upstream the porous bed/reaction microcavity (104*a-h*).

Steps (iii) and (iv) are performed in order to allow for an interaction between the solute (S') and the porous bed to take place. As mentioned in the introductory part, the steps may be part of (a) a separation method, and/or (b) a catalytic reaction, (c) a solid phase synthesis, and/or (d) a derivatization of the solid phase material/porous bed.

Separation comprises among others:

i) Capturing, i.e. the porous bed exhibits an affinity structure (affinity ligand, affinity reactant) ($AC'_S$') with binding ability for the solute (S'). When a liquid containing the solute (S') passes through the bed then the solute (S') will be captured/bound to the porous bed via $AC'_S$. After passage through the porous bed the liquid will be devoid or have a reduced amount of solute (S'). $AC'_S$ and S' will correspond to $AC_S$ and S, respectively, discussed above.

ii) Size exclusion, i.e. the porous bed is more prone to retain smaller molecules compared to larger molecules. The solute (S') will be retarded relative to the movement of a liquid front and therefore initially enriched in the wet porous bed.

iii) electrophoresis, i.e. the porous bed functions as anti-convection and/or anti-diffusion means.

For many separation protocols, a combination of two or more of capturing, size exclusion, electrophoresis etc is utilized either in consecutive beds or in the same bed.

The separation may be part of a purification or enrichment protocol for a solute that is present in the liquid. The solute that is separated from the liquid may be a contaminant or the entity to be purified, enriched etc. The separation may also be part of a synthetic protocol, preparative protocol, a cell based assay, various kinds of affinity assays including nucleic acid assays, immunoassays, enzyme assays etc.

An affinity assay utilizing a capturing step for binding a solute to a solid phase material typically contemplates characterization of a reaction variable involved in an affinity reaction of the assay. Reaction variables in this context are mainly of two types: 1) variables related to affinity reactants, and 2) reaction conditions. Variables of type 1 comprises two main subgroups a) amounts including presence and/or absence, concentration, relative amounts, activity such as binding activity and enzyme activity, etc, and b) properties of affinity reactants including affinity as such, e.g. affinity constants, specificities etc. See WO 02075312 (Gyros AB). The molecular entity for which a reaction variable of type 1 is characterized is called an analyte.

Catalytic reactions in the context of the present invention comprises that the solid phase material exhibits one or more immobilized members (e.g. affinity structure, affinity ligand, affinity reactant) of the catalytic system utilized, while other members of the same system are solutes. The catalytic reaction comprises formation of an affinity complex between the immobilized member (affinity structure, affinity ligand, affinity reactant) and at least one of the solute members. At least one of the members corresponds to the substrate for the catalytic system. The reaction results in a product that typically has a different chemical composition and/or structure compared to the substrate. The product may or may not become immobilized to the bed during the reaction.

The term "catalytic system" includes single catalytic system and more complex variants comprising a series of linked single enzyme systems, whole cells, cell parts exhibiting enzymatic activity etc. The bed may function as a catalytic reactor, such as an enzyme reactor.

The step during which interaction with the solute occurs may be part of a catalytic assay, such as an enzyme assay, for characterizing one or more members of the catalytic system or other reaction variables (e.g. reaction conditions). The assay may be for determining the activity of a particular catalyst, substrate, co-substrate, cofactor, co-catalyst etc in a liquid sample. The molecular entity/entities corresponding to the activity to be determined is/are called analyte/analytes. See for instance WO 03093802 (Gyros AB).

In the context of assays, the term analyte includes the entity to be characterized in an original sample as well as analyte-derived entities formed during the assay and being related quantitatively to the analyte in the original sample. The solute discussed above may be the original analyte or an analyte-derived entity.

Solid phase synthesis includes for instance polymer synthesis, such as oligopeptide and oligonucleotide synthesis and synthesis of other small molecules on a solid phase material. The immobilized reactant used in polymer synthesis, for instance, may exhibit the structure of the corresponding monomer, such as nucleotide, carbohydrate, amino acid structure, and mimetics of these structures. Synthesis of libraries of immobilized members of combinatorial libraries is also included. Such members have relatively low molecular weights (e.g. <10,000 dalton including a possible spacer to a polymeric backbone).

Solid phase derivatizatizion in the context of the present invention in most instances has as the goal to introduce an immobilized reactant or an activated functional group on the wet porous bed. Solid phase derivatization thus includes introduction of reactive structures or groups that permit immobilization of a desired reactant via covalent bonds or via affinity/adsorptive bonds. Thus starting from a wet porous bed that exposes an immobilized ligand L and passing a liquid containing an immobilizing conjugate (B-R=S'; B is an immobilizing affinity binder B and R is the reactant R to be immobilized), the reactant R will be firmly attached and exposed on the porous bed as discussed above for L and the immobilizing conjugate B-$AC_S$. If R is an affinity counterpart $AC_S$ to a solute S (B-R=B-$AC_S$) the resulting porous bed can be used as discussed above for capturing/separating the solute S from a liquid containing the solute S.

The transport during step (iv) comprises that the liquid is continuously flowing through the porous bed or that the liquid transport is halted when the liquid is within the bed. The interaction between a reactant immobilized on the bed and a solute can thus take place under flow condition or under static conditions, respectively. We have previously found that more information may be gained about reaction variables in affinity reactions if this kind of reactions is taking place under flow conditions (WO 02075312 (Gyros AB). The flow rate and/or residence time may for instance be adjusted such that the amount of solute (S) becoming bound to an affinity counterpart ($AC_S$) immobilized to the solid phase will reflect the actual reaction rate or affinity between an immobilized affinity reactant, typically $AC_S$, and a solute, typically solute S, with a minimum of perturbation by diffusion (non-diffusion limiting conditions). This also applies to the present invention but does not exclude that for applications where the primary interest is the total amount of bound/captured solute, capturing under flow conditions utilizing either diffusion limiting or non-diffusion limiting conditions can be used. The appropriate flow rate through the porous bed thus depends on a number of factors, e.g. the immobilized reactant and the solute and their sizes, the volume of the reaction microcavity, the porous bed including the solid phase material etc. Typically the flow rate should give a residence time of ≥0.010 seconds such as ≥0.050 sec or ≥0.1 sec with an upper limit that typically is below 2 hours such as below 1 hour. Illustrative flow rates are within 0.01-1000 nl/sec, such as 0.01-100 nl/sec and more typically 0.1-10 nl/sec. These flow rate intervals may be useful for bed volumes in the range of 1-200 nl, such as 1-50 nl or 1-25 nl. Residence time refers to the time it takes for a liquid aliquot to be in contact with the solid phase/porous bed in the reaction microcavity. These intervals are also applicable to other uses of the innovative microfluidic devices including separation, catalytic assays, solid phase synthesis, solid phase derivatization etc.

Best Mode

The best mode of the invention at the filing of this application is given in the experimental part and encompasses the solid phase materials shown, trehalose as bed-preserving agent, potassium phosphate as additional additive (buffer), and a microfluidic device with the microchannel structures given in FIG. 1.

EXPERIMENTAL PART

Figure 2A:
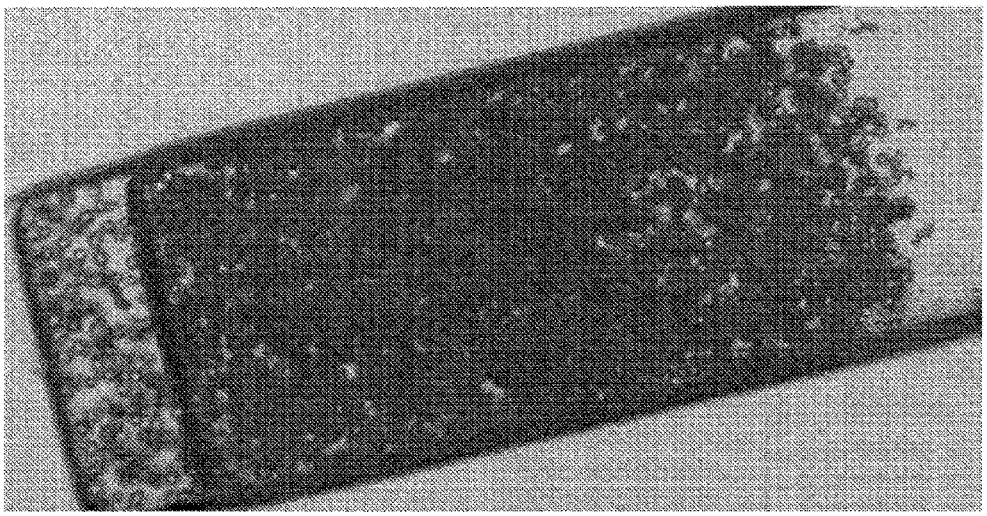
FIGS. 2*a* and *b* show a swellable solid phase material in particle form (Superdex™ Peptide, Amersham Biosciences, Uppsala, Sweden) placed in a reaction microcavity (104*a-h*).
Figure 2B:
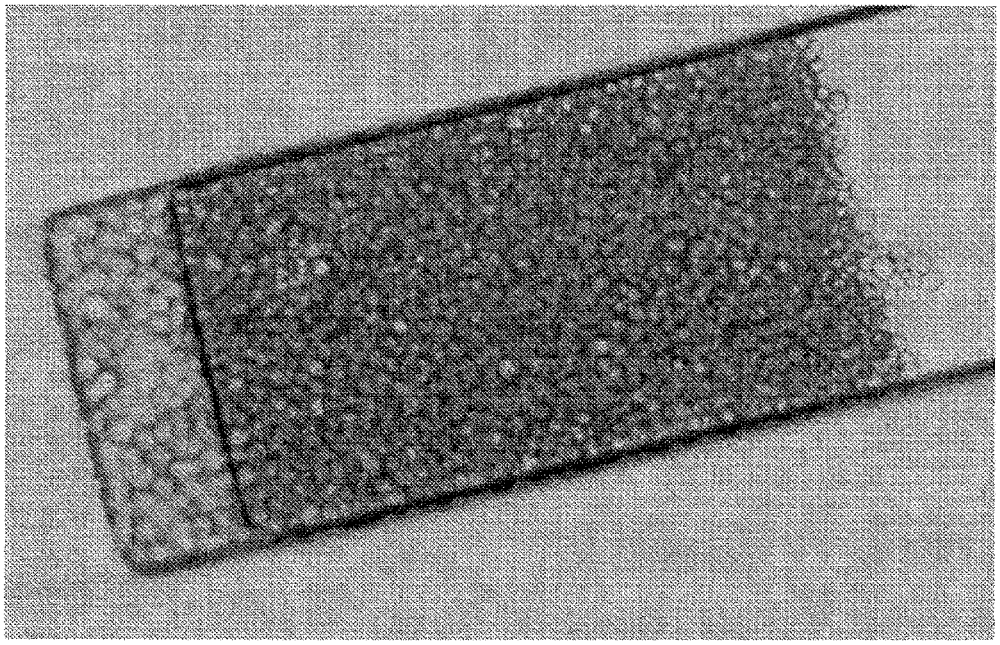
In FIG. 2*b* the solid phase material has been reconstituted to a well-ordered wet porous bed.
Figure 3:
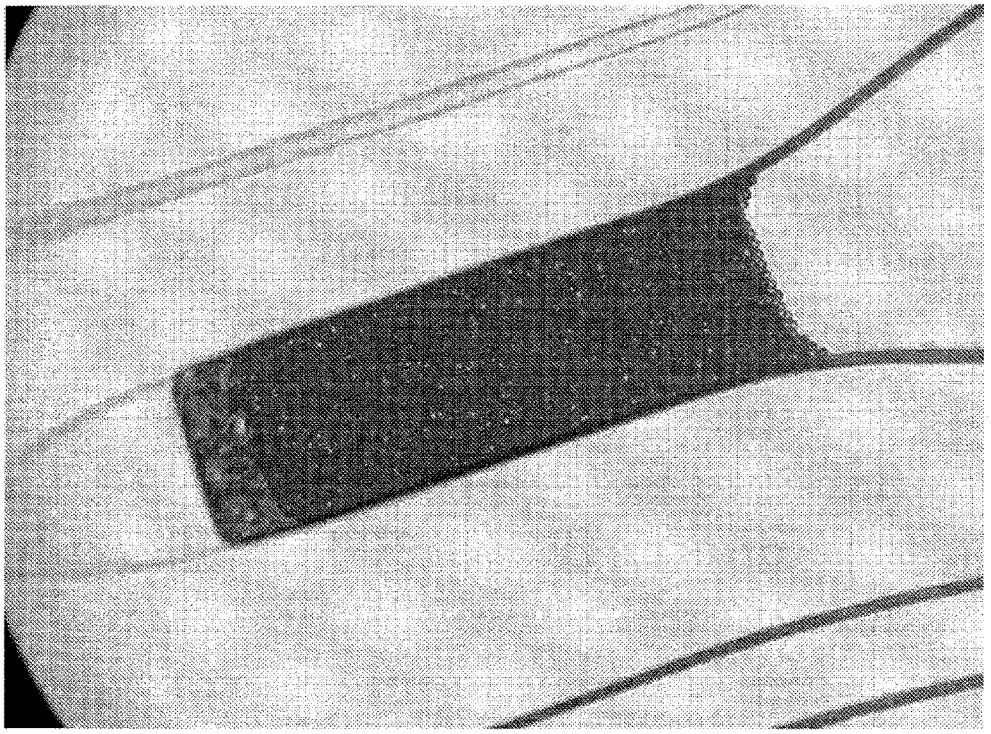
FIG. 3 shows monodisperse essentially non-swellable and hydrophilic particles packed to a porous bed and lyophilized in a reaction microcavity (104*a-h*). The bed looked essentially the same after reconstitution (not shown).

The microfluidic device used for the experiments was circular and of the same dimension as a conventional CD (compact disc). This microfluidic device will further on be called CD. The CD contained 14 groups (100) of 8 microchannel structures (101*a-h*) arranged in an annular zone around the center (spin axis) of the disc with a common waste channel (112) for each group close to the periphery. A group (100) of 8 microchannel structures (101*a-h*) is shown in FIG. 1 and is similar to and function in the same manner as the group of microchannel structures illustrated in FIGS. 1-2 in WO 02075312 (Gyros AB) and the corresponding figures in WO 03024548 (US 20030054563) (Gyros AB) and WO 03024598 (US 20030053934) (Gyros AB). The dimensions are essentially of the same size as in these earlier patent applications.

Each subset (100) comprises eight microchannel structures (101*a-h*) with one common inlet arrangement (102), one separate inlet arrangement (103*a-h*) per microchannel structure, and one reaction microcavity (104*a-h*) per microchannel structure. The common inlet arrangement comprises a) two common inlet ports (105*a-b*) that also will function as outlet ports for excess liquid, and b) one volume-metering unit (106*a-h*) for each microchannel structure (101*a-h*). The volume-metering units (106*a-h*) will function as a distribution manifold for the downstream parts of the microchannel structures. Each of the separate inlet arrangements (103*a-h*) is part of only one microchannel structure and comprises an inlet port (107*a-h*) and a volume-metering unit (108*a-h*). Between each volume-metering unit (106*a-h*, 108*a-h*) and their downstream parts, respectively, there is a valve function (109*a-h*, 110*a-h*), preferably passive. A reaction microcavity (104*a-h*) of a microchannel structure (101*a-h*) is located downstream both the common inlet arrangement (102) and a separate inlet arrangement (103*a-h*) of a microchannel structure (101*a-h*). At the outlet end (111*a-h*) of each reaction microcavity, the depth is lowered from 100 μm to 10 μm in two steps to prevent particles from escaping the reaction microcavity. Each reaction microcavity (104*a-h*) is in the downstream direction connected to an outlet microconduit (113*a-h*) that in FIG. 1 is illustrated as an outward bent and has an outlet end (114*a-h*) connected to a waste function (115*a-h*). At the periphery there is a common waste channel (112). Vents (116*a-i*, hydrophobic breaks) together with the valves (109*a-h*, hydrophobic breaks) define the volume of the liquid aliquots to be distributed downstream from each the volume-metering unit (106*a-h*).

By applying the appropriate volume of aqueous liquid to the inlet port of an inlet arrangement, capillarity will fill the volume-metering unit(s) connected to the inlet port with liquid. By spinning the disc around its center, liquid can be forced to pass the valve (109*a-h*,110*a-h*) between a volume-metering unit and downstream parts.

Spin-drying of wet packed beds can be employed, if the reaction microcavity (104*a-h*) is placed at a shorter radial distance from the spin axis than the outlet end (114) of the outlet microconduit (113). This is independent of the shape of the outlet microconduit (113).

Experimentals

Instrumentation

The immunoassay was performed in an automated system. The system (Gyrolab Workstation, prototype 2 instrument equipped with a Laser Induced Fluorescence (LIF) module, Gyros AB, Uppsala, Sweden) was equipped with a CD-spinner, holder for microtiter plates (MTP) and a robotic arm with a holder for 10 capillaries connected to 5 syringe pumps, 2 and 2. Two of the capillaries transferred all the reagents and buffers from a MTP to either of the two common inlet ports (105*a-b*) in the CD. The other eight capillaries transferred individual samples from a MTP to the separate individual inlet ports (107*a-h*) in the CD.

The Gyrolab Workstation is a fully automated robotic system controlled by application-specific software. An application specific method within the software controls the spinning of the CD at the precisely controlled speeds and thereby controls the movement of liquids through the microstructures as the application proceeds. Special software was included in order to reduce background noise.

See also WO 02075312 (Gyros AB), WO 03025548 and US 20030054563 (Gyros AB), WO 03025585 and US 200030055576 (Gyros AB), WO 03056517 and US 200301156763 (Gyros AB) and also www.gyros.com.

Solid Phase, Immobilization of Streptavidin, Packing, Drying/Dehydration and Reconstitution The solid phase bead material packed in the microstructures of the microfluidic device could be of either a porous or solid nature. For example polystyrene (PS) particles (15 μm, Dynal Biotech, Oslo, Norway) were selected for the solid phase. The beads were modified by passive adsorption of phenyl-dextran (PheDex) to create a hydrophilic surface and were subsequently covalently coupled with streptavidin (Immunopure Streptavidin, Pierce, Perbio Science UK Limited, Cheshire, United Kingdom) using CDAP chemistry (Kohn & Wilchek, Biochem. Biophys. Res. Commun. 107 (1982), 878-884). Other particles as Superdex Peptide and Sepharose HP (Amersham Biosciences, Uppsala, Sweden) have also been covalently coupled with streptavidin using CDAP chemistry (without phenyl-dextran coating). Streptavidin-biotin is a well-known bioaffinity pair. The polystyrene particles are solid and non-swellable in the reconstitution liquid used. Superdex Peptide and Sepharose HP are porous for many affinity reactants and swellable in the reconstitution liquids used.

After coupling with streptavidin, a suspension of the particles in potassium phosphate buffer (10 mM) without bed-preserving agent or with bed-preserving agent (in this case a sugar additive (10-100 mM)) was distributed in the common distribution channel via inlet port (105*a-b*) and moved through the structure by centrifugal force. The centrifugal force combined with the vents (109*a-h*,113*a-i*) divide the suspension in the common inlet arrangement (102) in equal portions, each of which forms a bed of packed particles (column) in each reaction microcavity (104*a-h*) against the dual depth at the outlet end (111*a-h*) of each reaction microcavity (104*a-h*). The approximate volume of the column was 15 nl. The columns/beds were dried/dehydrated by three various methods:

Drying at atmospheric pressure by the aid of wicking: The microfluidic device containing the wet porous beds was spun for one minute at 6000 rpm to remove as much of the fluid as possible before the device was put into a jewel case and sealed in a polymer-coated aluminum bag.

Vacuum-drying: The microfluidic device containing the wet porous beds was placed on trays and put into a vacuum drying oven (Heraeus vacutherm VT6060M). The temperature was set to 25° C. and the pressure was reduced by vacuum to 0.1 millibars. The device was maintained at this pressure and temperature for half an hours, until the product was dried. The pressure was then allowed to reach atmospheric pressure. The device was then placed into a jewel case and sealed in a polymer-coated aluminum bag.

Freeze-drying (lyohilization): The microfluidic device containing the wet porous beds were placed on a tray and put into a −80° C. freezer. (The device could also be placed in an ordinary −20° C. freezer for an hour.) After a few minutes all columns in the device were freezed and the trays where transferred to a freeze-dryer apparatus (Heto, LyoPro 3000) in which the condenser temperature was set to −57° C. The pressure was reduced (by vacuum) to 0.1-0.06 millibars. The device was maintained at this pressure and temperature until all of the ice had sublimed (about 12 hours or over night). The pressure was then allowed to reach atmospheric pressure during 2 minutes before the chamber was opened and the lyophilized product was provided in the device. The device was put into a jewel case and sealed in a in a polymer-coated aluminum bag.

Figure 4A:
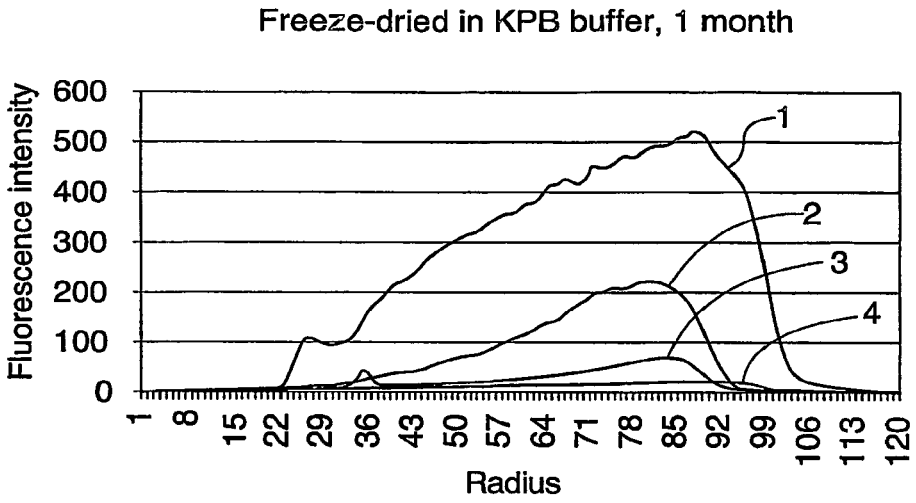
FIGS. 4*a* and *b* show the effect of drying (lyophilization) together with potassium phosphate buffer on the performance of a packed bed of particles to which streptavidin has been immobilized. Fluorescence intensity is given in radial direction through the bed (length of the bed) with the peak typically at the entrance. Flow direction is from the right to the left. Storage for one month at +4 oc. The effect is measured in a fluorescence myoglobin immunoassay (below) at four different concentrations of myoglobin and compared with the performance of a bed of the same material that has not been dried (lyophilized) (slurry). The myoglobin concentrations were 4.56 nM (graph 4), 22.8 nM (graph 3), 91.2 nM (graph 2) and 273.6 nM (graph 1).
Figure 4B:
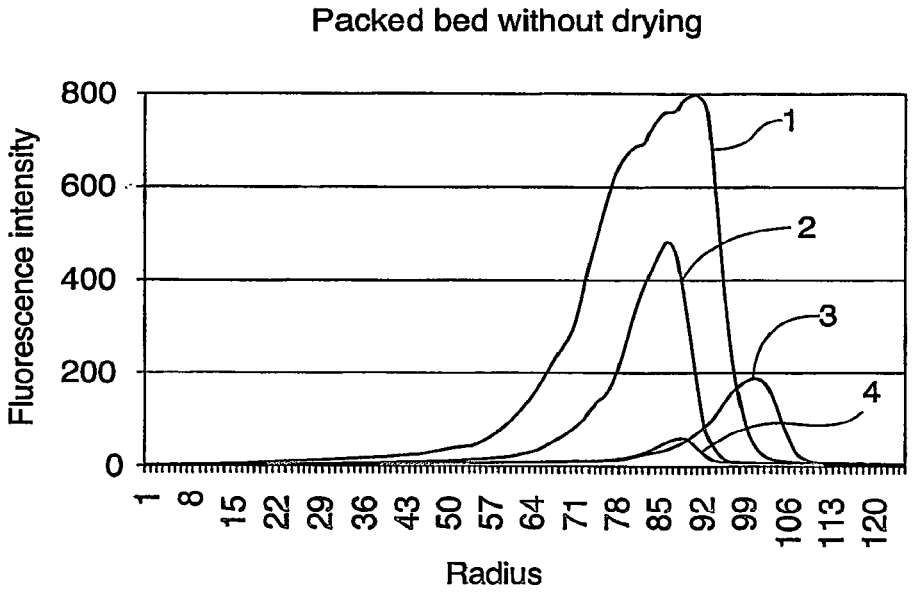
FIG. 4*b* is without drying.
Figure 5A:
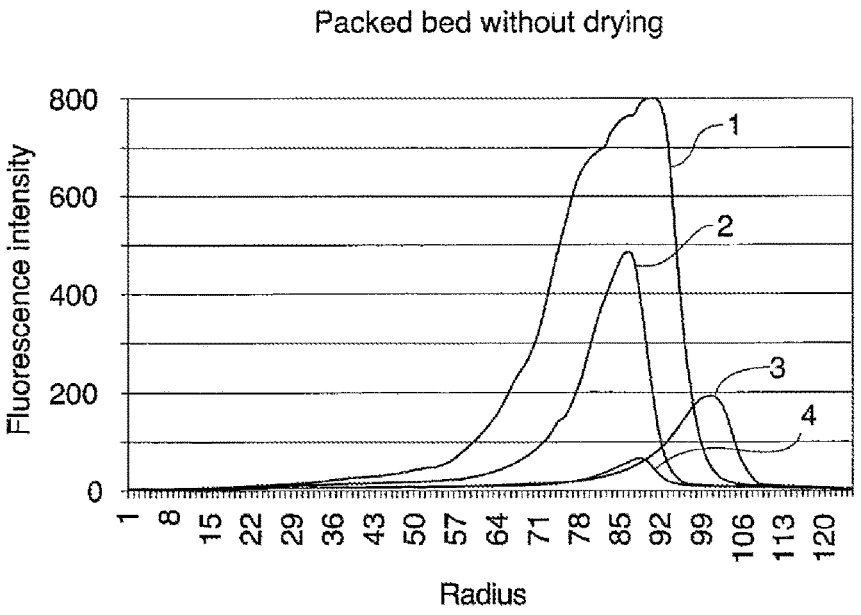
FIGS. 5*a-d* show the effect of three different drying procedures with a bed-preserving agent (sugar variant, trehalose) on the performance of a packed bed of particles to which streptavidin has been covalently coupled. Storage and measurement is the same as for FIGS. 4*a-b*.
Figure 5B:
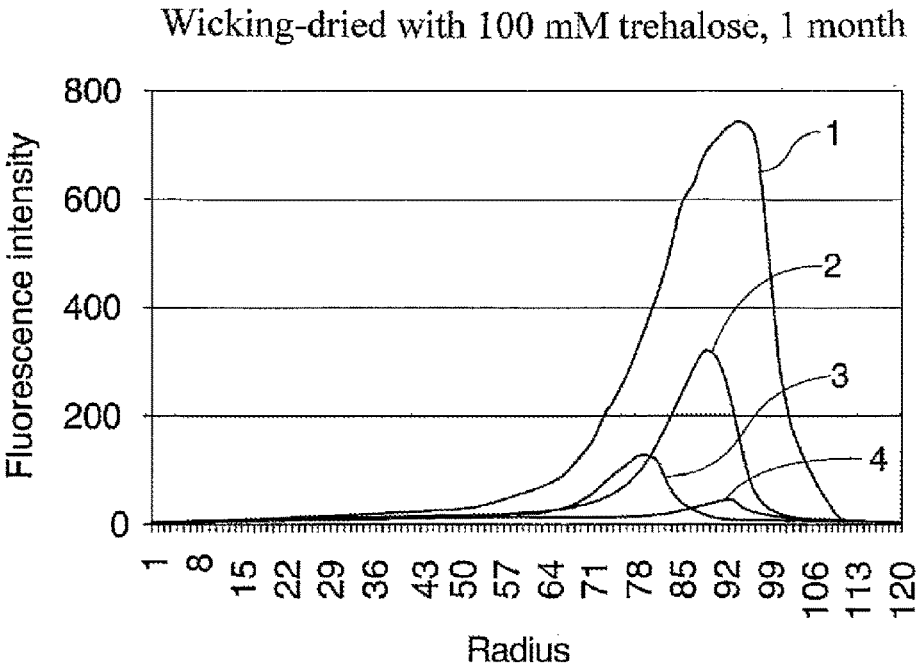
Figure 5C:
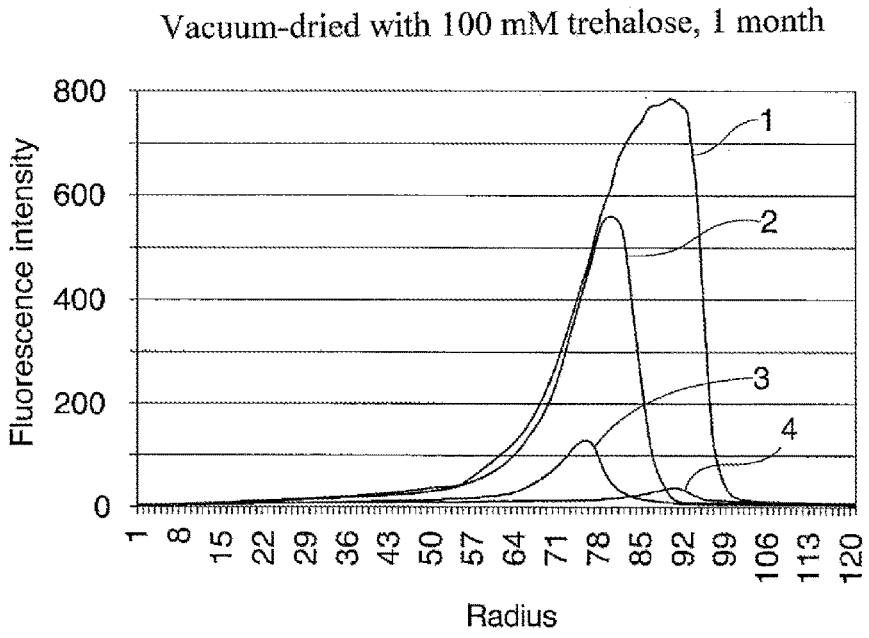
Figure 5D:
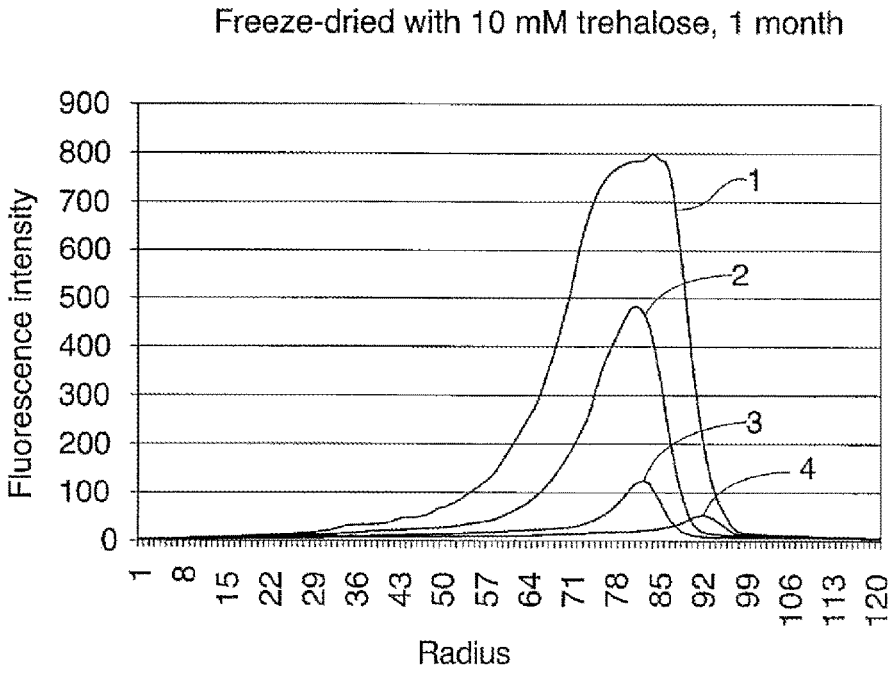

The devices were stored for one month at +4° C. after which the dry columns were rewetted/reconstituted once with 15 mM phosphate buffer (PBS), pH 7.4 containing 0.15 M NaCl, 0.02% $NaN_3$ and 0.01% Tween® 20 via the common distribution channel and spinning at the appropriate rate. Every addition of solution delivers 200 nl liquid to the individual column (104*a-h*). Finally the function of the reconstituted beds was tested in the immunoassay given below at four different analyte (myoglobin) concentrations and compared with the corresponding beds that had not been dried/dehydrated. The results are presented in FIGS. 4-5 and show that it is more or less imperative to include a bed-preserving agent in order to reconstitute the dry/dehydrated solid phase material to an efficient wet porous bed.

Immunoassay

The catching antibody (=$AC_S$) in our myoglobin assay, the monoclonal antimyoglobin 8E11.1 (LabAS, Tartu, Estonia) was biotinylated using Sulfo-NHS-LC-biotin (Pierce, prod # 21335, Perbio Science UK Limited, Cheshire, United Kingdom). The protein concentration of the monoclonal antimyoglobin 8E11.1 was 1-10 mg/ml and it was incubated in room temperature for 1 h with 3× molar excess of the biotinylation reagent in 15 mM PBS with 0.15 M NaCl before it was gel filtrated through either a NAP-5 column (Amersham Biosciences, Uppsala, Sweden) or a Protein Desalting Spin Column (Pierce, # 89849-P, Perbio Science UK Limited, Cheshire, United Kingdom).

To load the streptavidin immobilized particles with the biotinylated antibody, a solution at a 0.2-2 mg/ml concentration (depending of how much streptavidin it is in the packed column) of antibody was distributed in the common distribution channel via inlet port (105*a-b*) and moved through the structure by centrifugal force. The flow rate through the columns was controlled by the spin velocity (spin flow 1). After the capturing antibody was attached to the columns they were washed once by addition of PBS (with 0.01% Tween 20) to the common distribution channel (inlet ports 105*a* or *b*) followed by a spin step.

Figure 6:
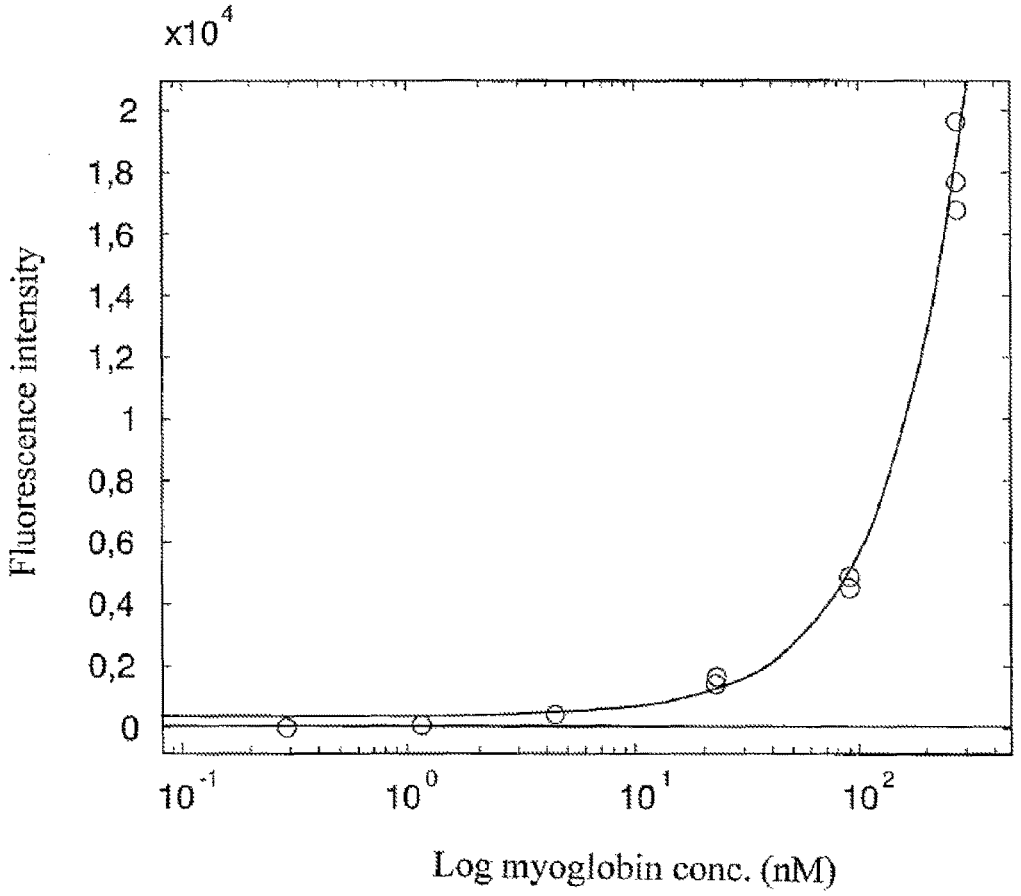
FIG. 6 shows a standard curve for the immunoassay given in the experimental part with myoglobin samples (diluted in PBS with 1% BSA, concentrations of myoglobin ~0-274 nM). Solid phase (PS-PheDex-streptavidin in 100 mM trehalose) dried at atmospheric pressure, storage 1 month at +4° C. The y-axis gives fluorescence and the x-axis concentration log.
Figure 7A:
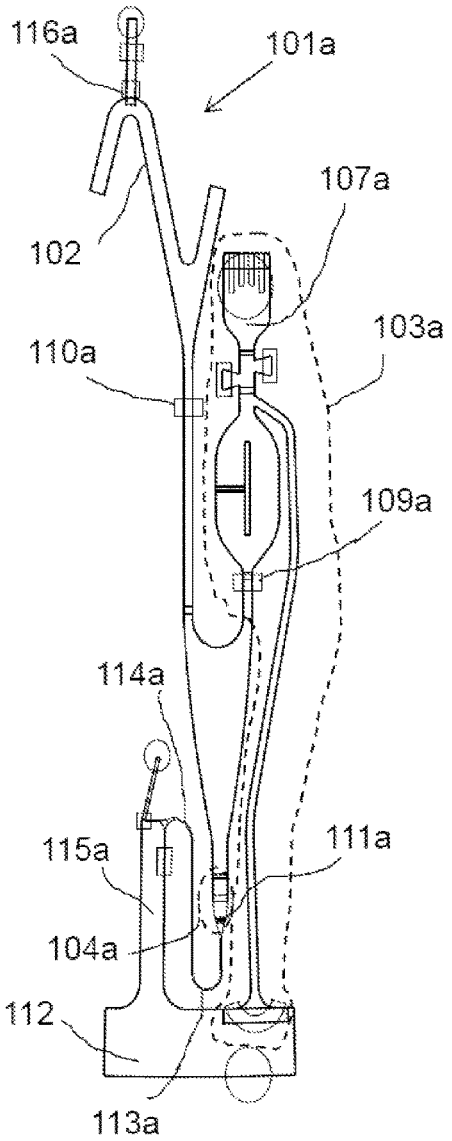
FIGS. 7*a* and *b* are exploded views of microchannel structures 101*a* and 101*d*, respectively, of the microfluidic device utilized in the experimental part.
Figure 7B:
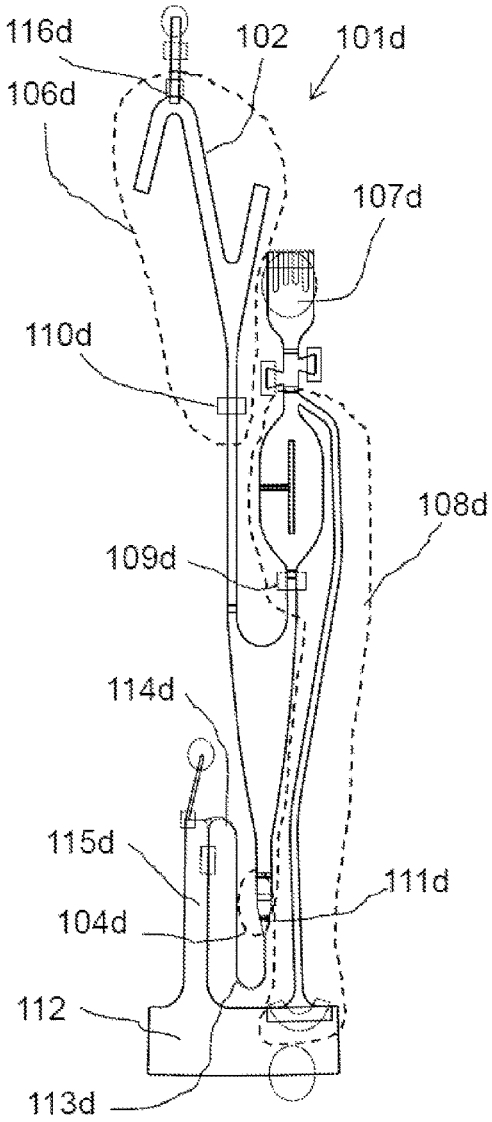

To demonstrate the myoglobin assay in Gyrolab Workstation a 6-point standard curve was created (FIG. 6). The myoglobin samples (diluted in PBS with 1% BSA) with concentrations in the range of 0-274 nM where distributed to the individual inlet ports (107*a-h*) by the capillaries. The sample volume 200 nl was defined into the volume-metering unit (108*a-h*), during the first two steps in the spin flow method. To reach favourable kinetic condition under the capturing step (for myoglobin to bind to 8E11.1) the flow rate of the sample should not exceed 1 nl/sec. The sample flow rate was controlled by spin flow 2. After sample capturing the columns was washed twice by addition PBS (with 0.01% Tween 20) to the common distribution channel (inlet port 105*a* or *b*) followed by a spin step. Detecting antibodies (monoclonal antimyoglobin 2F9.1 (LabAs, Tartu, Estonia)) in excess were applied next via the common distribution channel (inlet port 105*a* or *b*) and a similar slow flow rate (spin flow 3) was used. The detecting antibodies were labeled with a fluorophore Alexa 633 (Molecular Probes, Eugene, USA). Excess of labeled antibody was washed away by 4 additions of PBS (with 0.01% Tween 20) to the common distribution channel (inlet port 105*a* or *b*) followed by a spin step.

The complete assay was analyzed in the Laser Induced Fluorescence (LIF) detector module. See more WO 02075312 (Gyros AB), WO 03025548 and US 20030054563 (Gyros AB), and WO 03056517 and Ser. No. 10/331,399 (Gyros AB).

An overview of the run method performed in the system is presented in Table 1.

TABLE 1

| Method | Spin profile |
|---|---|
| Rewetting of bead columns | |
| Spin 1 | 2500 rpm 5 s, 6000 rpm 10 s |
| Wash of beads | |
| Spin 2 | 1200 rpm 2 s, 2500 rpm 0.5 s, 4000 rpm 10 s, 6500 rpm 16 s |
| Transfer of biotinylated antibody | |
| Spin flow 1 | 1200 rpm 2 s, 2500 rpm 0.5 s, from 1200-1500 rpm 45 s, 2000 rpm 35 s, 3000 rpm 30 s, 4000 rpm 10 s, 5000 rpm 5 s, 6000 rpm 10 s |
| Wash of beads and CD-structure 1 | |
| Spin 3 | 1200 rpm 2 s, 2500 rpm 1 s, 4000 rpm 15 s, 6000 rpm 18 s |
| Transfer of myoglobin samples | |
| Spin flow 2 | 1000 rpm 5 s, 2500 rpm 0.5 s, from 1200-1500 rpm 90 s, 2000 rpm 70 s, 3000 rpm 60 s, 4000 rpm 20 s, 5000 rpm 10 s |
| Myoglobin wash 1 | |
| Spin 4 | 1200 rpm 2 s, 2500 rpm 0.5 s, 4000 rpm 10 s, 6000 rpm 16 s |

TABLE 1-continued

| Method | Spin profile |
|---|---|
| Myoglobin wash 2 | |
| Spin 5 | 1200 rpm 2 s, 2500 rpm 0.5 s, 4000 rpm 10 s, 6000 rpm 16 s |
| Transfer of conjugate | |
| Spin flow 3 | 1200 rpm 2 s, 2500 rpm 0.5 s, from 1200-1500 rpm 90 s, 2000 rpm 70 s, 3000 rpm 60 s, 4000 rpm 20 s, 5000 rpm 10 s |
| Conjugate wash 1 | |
| Spin 6 | 1200 rpm 2 s, 2500 rpm 0.5 s, 4000 rpm 10 s, 6000 rpm 16 s |
| Conjugate wash 2 | |
| Spin 7 | 1200 rpm 2 s, 2500 rpm 0.5 s, 4000 rpm 10 s, 6000 rpm 16 s |
| Conjugate wash 3 | |
| Spin 8 | 1200 rpm 2 s, 2500 rpm 0.5 s, 4000 rpm 10 s, 6000 rpm 16 s |
| Conjugate wash 4 | |
| Spin 9 | 1200 rpm 2 s, 2500 rpm 0.5 s, 4000 rpm 10 s, 6000 rpm 16 s |
| Detection | |

Drying and Reconstitution

Certain innovative aspects of the invention are defined in more detail in the appending claims. Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps

The invention claimed is:

1. A method for the transformation of a plurality of wet porous beds to a dry/dehydrated state that is reconstituted to a plurality of wet porous beds, comprising the steps of:

i) providing a microfluidic device comprising a plurality of microchannel structures each of which comprises a reaction microcavity containing a hydrophilic porous solid phase material bed of porous or non-porous particles saturated with a liquid containing a bed-preserving agent comprising one or more compounds having bed-preserving activity, wherein the outlet end of the reaction microcavity and the particles are designed so as to prevent the particles from escaping the microcavity, ii) transforming the bed in each reaction microcavity to a solid phase material that is in a dry and/or dehydrated state while being retained in the reaction microcavity, said one or more compounds comprising a water-soluble agent causing the particles of the bed to adhere to each other in the dry and/or dehydrated state, and iii) reconstituting under flow conditions in each reaction microcavity the solid phase material obtained in step ii) to the wet porous bed, wherein the bed-preserving agent stabilizes the solid phase material bed during steps i) to iii), wherein the porous bed is a packed bed of the particles, and wherein the bed-preserving agent after step ii) is present in the dry solid phase in an amount in the interval of 0.0001-25%.

2. The method according to claim 1, wherein at least one of said one or more compounds a) exhibits a hydrophilic group that may or may not be non-ionic, and b) is water-soluble.

3. The method according to claim 1, wherein at least one of said one or more compounds is a polyol.

4. The method according to claim 1, wherein at least one of said one or more compounds exhibits a carbohydrate structure.

5. The method according to claim 1, wherein at least one of said one or more compounds is a disaccharide.

6. The method according to claim 1, wherein at least one of said compounds is a microcavity adherence agent causing the particles to adhere to the inner walls of a reaction microcavity.

7. The method according to claim 1, wherein said liquid comprises a non-volatile buffer.

8. The method according to claim 1, wherein said transformation to the dry state is accomplished by removing liquid under subatmospheric pressure from the porous bed saturated with an aqueous liquid, above or below the freezing point of the liquid, or by drying the porous bed saturated with water in ambient atmosphere with or without warming.

9. The method according to claim 1, wherein said solid phase material is swellable or not swellable.

10. The method according to claim 1, wherein each microchannel structure is designed for driving a liquid flow through at least a portion of the structure by centrifugal force.

11. The method according to claim 1, wherein the solid phase material comprises an immobilized reactant.

12. The method according to claim 11, wherein the immobilized reactant is an immobilized ligand L which is a member of an immobilizing affinity pair comprising L and an affinity counterpart B to L and which is intended for the immobilization of a conjugate B-$AC_S$ to the porous bed, where $AC_S$ is an affinity counterpart to a solute S.

13. The method according to claim 12, wherein the affinity constant for formation of a complex between the solute S and the affinity counterpart $AC_S$ to the solute is at most $10^{-6}$ mole/l.

14. The method according to claim 13, wherein the affinity constant for the immobilizing affinity pair is at most $10^3$ times larger than the corresponding affinity constant for streptavidin and biotin.

15. The method according to claim 14, wherein B has one or more binding sites for L, and L has two or more binding sites for B, or L has one or more binding sites for B, and B has two or more binding sites for L.

16. The method according to claim 13, wherein at least one of S and $AC_S$ or at least one of L, B, $AC_S$ and S comprise a structure selected from the group consisting of poly/oligo-peptide and protein structure, carbohydrate structure, nucleotide structure, and lipid structure.

17. The method according to claim 1, further comprising the steps of:

(iv) providing a liquid containing a solute S' in a position that is upstream to said wet porous bed in one or more of the microchannel structures containing the wet porous bed, and (v) transporting the liquid through said wet bed in at least one of said one or more microchannel structures.

18. The method according to claim 17, wherein the solute S' is capable of interacting with the wet porous bed.

19. The method according to claim 1, wherein transforming the bed to a solid phase material that is in a dry and/or dehydrated step occurs by a combination of centrifugal force and wicking.

20. The method according to claim 1, wherein the bed-preserving agent in the solid phase material that is in the dry state is in an amount of >0.1%.

21. The method according to claim 1, wherein the wet porous bed is subjected to spin-drying and wherein the reaction microcavity is placed at a shorter radial distance from a spin axis than the outlet end of an outlet microconduit.

22. The method of claim 1, wherein the bed-preserving agent after step ii) is present in the dry solid phase in an amount in the interval of 0.001%-10%.

23. The method of claim 1, wherein the bed-preserving agent after step ii) is present in the dry solid phase in an amount in the interval of 0.001%-1%.

24. The method of claim 1, wherein the bed-preserving agent after step ii) is present in the dry solid phase in an amount in the interval of 0.01%-10%.

25. The method of claim 1, wherein the bed-preserving agent after step ii) is present in the dry solid phase in an amount in the interval of 0.01%-1%.

26. The method of claim 1, wherein the bed-preserving agent after step ii) is present in the dry solid phase in an amount in the interval of 0.1%-10%.

27. The method of claim 1, wherein the bed-preserving agent after step ii) is present in the dry solid phase in an amount in the interval of 0.1%-1%.

* * * * *